US006651747B2

(12) United States Patent
Chen et al.

(10) Patent No.: US 6,651,747 B2
(45) Date of Patent: Nov. 25, 2003

(54) DOWNHOLE ANCHORING TOOLS CONVEYED BY NON-RIGID CARRIERS

(75) Inventors: Kuo-Chiang Chen, Sugar Land, TX (US); James S. Almaguer, Richmond, TX (US); Simon L. Farrant, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 67 days.

(21) Appl. No.: 10/008,761

(22) Filed: Nov. 8, 2001

(65) Prior Publication Data

US 2002/0053434 A1 May 9, 2002

Related U.S. Application Data

(63) Continuation-in-part of application No. 09/611,128, filed on Jul. 6, 2000, now Pat. No. 6,315,043.

(60) Provisional application No. 60/156,660, filed on Sep. 29, 1999, and provisional application No. 60/142,566, filed on Jul. 7, 1999.

(51) Int. Cl.[7] ..... E21B 23/00

(52) U.S. Cl. ..... 166/382; 166/66.4; 166/212; 166/217

(58) Field of Search ..... 166/382, 66.4, 166/212, 213, 214, 217, 297

(56) References Cited

U.S. PATENT DOCUMENTS

| | | | | | |
|---|---|---|---|---|---|
| 3,664,416 | A | * | 5/1972 | Nicolas et al. | 166/65 |
| 3,686,943 | A | | 8/1972 | Smith | 73/151 |
| 4,429,741 | A | | 2/1984 | Hyland | 166/63 |
| 4,671,356 | A | * | 6/1987 | Barker et al. | 166/285 |
| 5,184,676 | A | | 2/1993 | Graham et al. | 166/66.4 |
| 5,343,963 | A | | 9/1994 | Bouldin et al. | 175/27 |
| 5,765,640 | A | * | 6/1998 | Milne et al. | 166/206 |
| 5,769,163 | A | | 6/1998 | Meynier | 166/206 |
| 5,954,131 | A | | 9/1999 | Sallwasser | 166/254.2 |
| 6,112,809 | A | | 9/2000 | Angle | 166/66 |
| 6,311,778 | B1 | * | 11/2001 | Carisella et al. | 166/382 |
| 6,315,043 | B1 | * | 11/2001 | Farrant et al. | 166/297 |
| 2002/0032126 | A1 | * | 3/2002 | Kusmer | 507/100 |
| 2002/0100360 | A1 | * | 8/2002 | Rochen et al. | 89/1.15 |
| 2002/0104686 | A1 | * | 8/2002 | Bloom et al. | 175/99 |
| 2002/0166667 | A1 | * | 11/2002 | Patel et al. | 166/373 |
| 2003/0024710 | A1 | * | 2/2003 | Post et al. | 166/382 |

OTHER PUBLICATIONS

Christopher J. Pinto et al., "New Wireline Perforating Anchor Tool," Oil&Gas Journal, pp. 51–53 (May 14, 2001).

* cited by examiner

*Primary Examiner*—William Neuder
(74) *Attorney, Agent, or Firm*—Trop, Pruner & Hu, P.C.; Jeffrey E. Griffin; Brigitte Jeffery Echols

(57) ABSTRACT

An apparatus and method provides an anchoring apparatus for use in a wellbore that comprises a gripping assembly and an actuation assembly. In one arrangement, the actuation assembly includes a motor and a module having at least a compressible element (e.g., a hydraulic module) between the motor and the gripping assembly. Upon activation, the motor actuates the hydraulic module to cause activation of the gripping assembly. In one arrangement, the anchoring apparatus is designed to pass through a tubing or other restriction in the wellbore. When in the retracted state, the gripping assembly of the anchoring apparatus has an outer diameter that is smaller than an inner diameter of the tubing. When in the expanded state, the gripping assembly of the anchoring apparatus has an outer diameter than is substantially the same as the inner diameter of the liner to enable engagement of the gripping assembly against the liner.

42 Claims, 34 Drawing Sheets

DOWNHOLE ANCHORING TOOLS CONVEYED BY NON-RIGID CARRIERS

CROSS REFERENCE TO RELATED APPLICATIONS

This is a continuation-in-part of U.S. Ser. No. 09/611,128, filed Jul. 6, 2000 now U.S. Pat. No. 6,315,043, which claims priority under 35 U.S.C. §119(e) to U.S. Provisional Patent Application Serial No. 60/156,660, entitled "Downhole Anchoring Tools Conveyed by Non-Rigid Carriers" filed Sep. 29, 1999; and to U.S. Provisional Patent Application Serial No. 60/142,566, entitled "Downhole Anchoring Tools Conveyed by Non-Rigid Carriers," filed Jul. 7, 1999.

TECHNICAL FIELD

The invention relates to downhole anchoring tools conveyed by non-rigid carriers, such as wirelines or slicklines.

BACKGROUND

To complete a well, one or more formation zones adjacent a wellbore are perforated to allow fluid from the formation zones to flow into the well for production to the surface. A perforating gun string may be lowered into the well and the guns fired to create openings in casing and to extend perforations into the surrounding formation.

For higher productivity, underbalanced perforating may be performed in which the pressure in the wellbore is maintained lower than the pressure in a target formation. With underbalanced perforating, formation fluid flow can immediately begin to enter the wellbore. The pressure difference between the formation and the wellbore in the underbalance condition may help clear the perforations by removing crushed rock, debris, and explosive gases from the formation. However, perforating in an underbalance condition may cause a sudden surge in fluid flow from the formation into the wellbore, which may create a pressure impulse that causes movement of the perforating gun string, particularly if the gun string is carried by a non-rigid carrier such as a wireline. If the pressure impulse from the surge is large enough, the perforating gun string and associated equipment may get blown up or down the well, which may cause the perforating gun string to be stuck in the well because of entanglement with cables and other downhole equipment. The shock created by the pressure impulse may also cause the perforating gun string to break from its carrier. Pressure impulses may also be caused by other conditions, such as when valves open, another perforating gun is fired, during gas (propellant) fracture stimulation, and so forth.

To address the problem of undesired movement of perforating gun strings, "reactive" anchors have been used. Such relative anchors are actuated in response to pressure impulses of greater than predetermined levels that cause acceleration of the anchor. In response to greater than predetermined acceleration, the anchor sets to effectively provide a brake against the inner wall of the wellbore to prevent the perforating gun string from moving too large a distance.

However, a disadvantage of such anchors may be that, although movement is limited, undesirable displacement may still occur in the presence of pressure surges from various sources in a wellbore. Such displacement may cause a perforating gun string to be moved out of the desired depth of perforation. A surge in fluid flow may occur during draw down of a wellbore to an underbalance condition. To reduce the pressure inside the wellbore relative to the formation pressure of a first zone, a second zone may be produced to create a rapid flow of fluid in the wellbore to the surface to lower the wellbore pressure. If the initial pressure surge due to production from the second zone is large enough, a perforating gun string located in the wellbore may be displaced a certain distance before a reactive anchor connected to the gun string is able to stop the string.

Another disadvantage of reactive anchor systems may be that they are responsive only to force applied from one direction. Thus, such anchors may not actuate in response to a pressure surge from an opposite direction. A further disadvantage may be that such anchors are not positively retracted.

Another type of anchor device is one which is set and released by cycling the wireline or slickline up and down. These types of devices typically employ a "J"-slot type mechanism which allows cycling of the anchor section from the set position to the release position. The problem with these devices is that they do not operate reliably at high angles of wellbore inclination (e.g., >45 degrees). The problem is accentuated more when the well has a tortuous trajectory which makes operating any device by means of cable movement impractical.

Thus, an improved anchoring method and apparatus is needed for use with downhole tools such as perforating gun strings.

SUMMARY

In general, according to one embodiment, an anchoring apparatus for use in a wellbore comprises a motor, a module having at least one compressible element, and a gripping assembly adapted to be actuated by the motor through the at least one compressible element in the module.

In general, according to another embodiment, a method for use in a wellbore having a liner comprises lowering a tool string having an anchor device through a restriction positioned in the wellbore. The anchor device has a retracted state in which the anchor device has an outer diameter less than the inner diameter of the restriction. The tool string is positioned at a target interval within the liner. The anchor device is expanded to an expanded state to actuate a gripping assembly of the anchor device to engage the liner.

Other or alternative features will become apparent from the following description, from the drawings, and from the claims.

DETAILED DESCRIPTION

In the following description, numerous details are set forth to provide an understanding of the present invention. However, it is to be understood by those skilled in the art that the present invention may be practiced without these details and that numerous variations or modifications from the described embodiments may be possible. For example, although reference is made to an anchor device for use with a perforating gun string in the described embodiments, an anchor device for use with other tool strings may be used with further embodiments.

As used herein, the terms "up" and "down"; "upper" and "lower"; "upwardly" and "downwardly"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other suitable relationship as appropriate.

Figure 1:
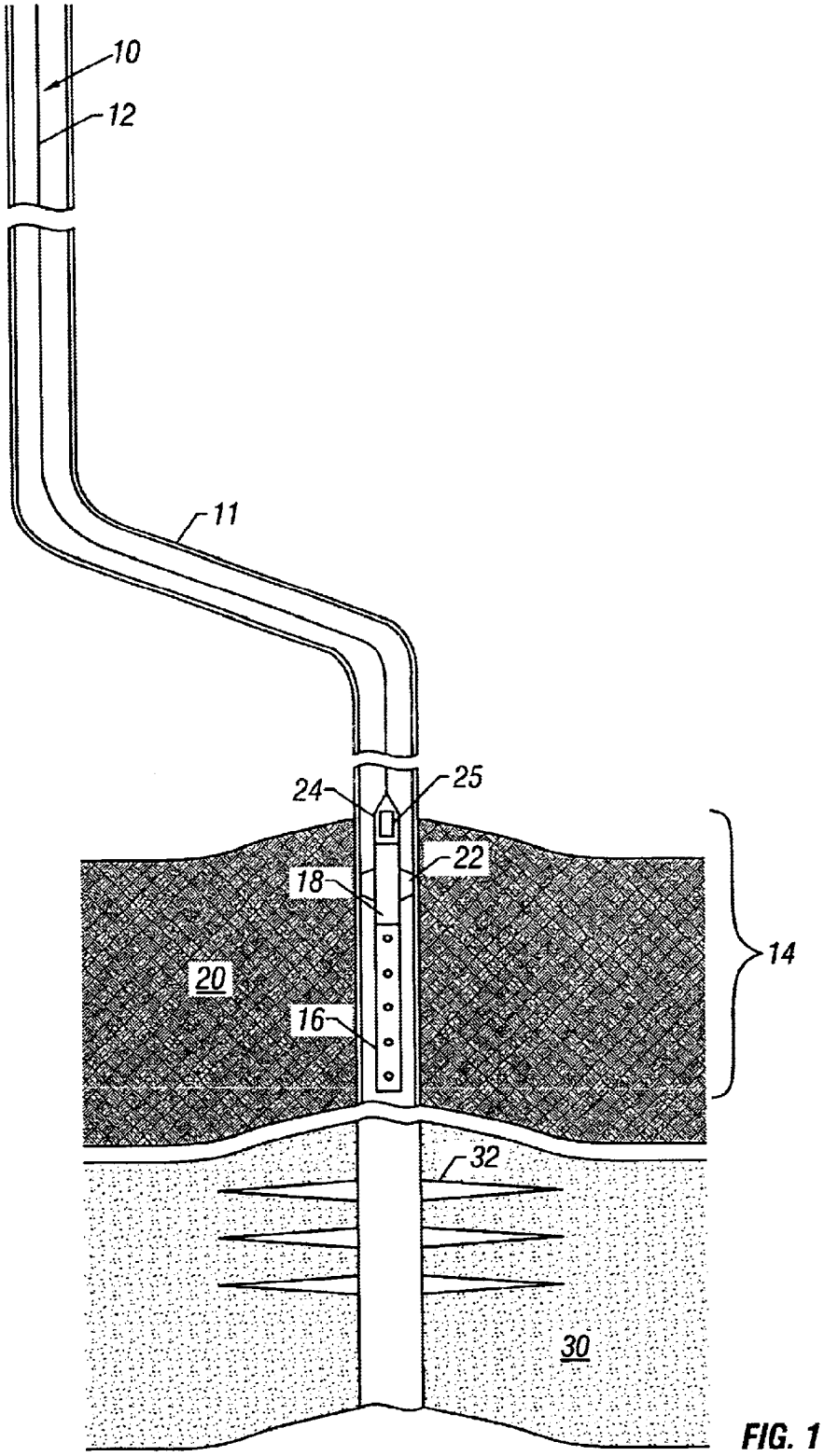
FIG. 1 illustrates an embodiment of a perforating gun string positioned in a wellbore.

Referring to FIG. 1, a perforating gun string 14 is positioned in a wellbore 10 that may be lined with casing, liner, and/or tubing 11. As used here, a "liner" may refer to either casing or liner. The perforating gun string 14 is lowered into the wellbore 10 on a non-rigid carrier, such as a wireline or a slickline. The perforating gun string 14 (or other tool string) includes a perforating gun 16 (or another tool) and an anchor device 18 in accordance with some embodiments. When the perforating gun string 14 is lowered to a target depth, such as in the proximity of an upper formation zone 20, the anchor device 18 is actuated to set engagement members 22 against the inner wall of the liner or tubing 11 in the wellbore 10. In one embodiment, the anchor device 18 may be actuated by electrical signals sent down the wireline 12. Alternatively, if the non-rigid carrier 12 is a slickline, then an adapter 24 coupled to the slickline 12 may include a motion transducer 25 (e.g., an accelerometer) that converts motion on the slickline 12 into electrical signals that are sent to actuate the anchor device 18. Thus, an operator at the surface can jerk or pull on the slickline 12 according to a predetermined pattern, which is translated by the motion transducer 25 into signals to actuate the anchor device 18 or to fire the perforating gun 16. In either embodiment, a signal (electrical signal, motion signal, or other signal) is applied or transmitted over the non-rigid carrier to the perforating gun string.

Generally, the anchor device 18 in accordance with some embodiments may be set "on-demand" by a surface or remote device, such as over a wireline or slickline. The anchor device 18 can be set in the wellbore 10 regardless of pressure or flow conditions in the wellbore. Thus, the anchor device 18 in accordance with some embodiments can be set downhole without the need for the presence of predetermined pressure impulses. This provides flexibility in setting the anchor device 18 whenever and wherever desired in the wellbore 10. For example, in one application, the anchor device 18 may be set in the wellbore 10 before an underbalance condition is created in the wellbore 10. Such an underbalance condition may be created by producing from a lower zone 30 through perforations 32 into the wellbore 10. By opening a valve at the surface, for example, the lower zone 30 can be produced to create a rapid flow of fluid to lower the pressure in the wellbore 10. The lowered pressure in the wellbore 10 provides an underbalance condition of the wellbore 10 with respect to the formation zone 20. The lower the wellbore pressure, the higher the underbalance condition.

When a valve is opened to provide fluid production from the zone 30, the surge in fluid flow may cause a pressure impulse to be created upwardly. This applies an upward force against the perforating gun string 14. However, in accordance with some embodiments, since the anchor device 18 has already been set remotely by providing an actuating signal, the perforating gun string 14 is not moved by any substantial amount in the axial direction of the wellbore 10 by the pressure impulse. Thus, advantageously, the perforating gun string 14 may be maintained in position with respect to the zone 20 so that subsequent firing of the gun string 14 creates perforations at a desired depth. Thus, even in the presence of an "extreme" underbalance condition in the wellbore 10, the perforating gun string 14 can be maintained in position. What constitutes an extreme underbalance condition is dependent on the wellbore environment. Example values of pressure differences between a target formation and a wellbore may start at 500 psi.

A further advantage provided by the anchor device 18 in accordance with some embodiments is that it protects the perforating gun string 14 from movement even in the presence of a pressure impulse directed downwardly against the perforating gun string 14. In other words, the anchor device 18 provides effective protection against movement by pressure impulses from either the up or down direction (or from any other direction). The anchor device 18 also reduces movement of the perforating gun string upon firing the perforating gun.

The arrangement of FIG. 1 shows a perforating gun string that is run into a monobore. In another arrangement, a tubing or pipe of smaller diameter is provided in the liner 11. In this arrangement, the perforating gun string is run through the narrower tubing or pipe. As a result, in its retracted state, the anchor device has to have an outer diameter less than the inner diameter of the tubing or pipe to pass through the tubing or pipe. However, for setting in the liner 11 after the perforating gun string exits the tubing or pipe, the anchor device has to expand to a diameter large enough to engage the inner diameter of the liner 11. This "through-tubing" anchor device is described below in connection with FIGS. 1–18.

Referring to FIGS. 2A–2E, the anchor device 18 for use in the wellbore of FIG. 1 is illustrated in greater detail. The anchor device 18 includes a plurality of engagement members 22 (cross-sectional view shown in FIG. 2C and perspective view shown in FIG. 3) that are adapted to translate radially to engage or retract from the inner wall of the liner or tubing 11. In other embodiments, different forms and numbers of the engagement members 22 may be provided. The engagement members 22 may be dovetail slips, for example, that are coupled to a setting operator that, in one embodiment, includes a setting piston 102, a setting mandrel 104, and an energy source 110 to move the setting mandrel 104 and setting piston 102. In other embodiments, the setting operator may be arranged differently. Also, other types of such engagement members may be employed, such as a linkage mechanism in which a radially moveable member is attached by links to longitudinally moveable members. Movement of the longitudinally movement members causes radial movement of the radially moveable member.

The setting piston 102 is adapted to move longitudinally inside the housing of the anchor device 18. The setting mandrel 104 that is integrally attached to the setting piston 102 extends upwardly in the anchor device 18. A setting piston 106 is formed on the outer surface of the setting mandrel 104. The energy source 110 (FIG. 2B), such as a spring mechanism including spring washers in one embodiment, is positioned in an annular region between the outer surface of the setting mandrel 104 and the inner surface of the anchor housing to act against the upper surface 108 of the setting piston 106 of the setting mandrel 104. The other end of the spring mechanism 110 abuts a lower surface 112 of an actuator sleeve 114 that provides a reference surface from which the spring mechanism 110 can push downwardly on the setting mandrel 104. The spring mechanism 110 is shown in its initial cocked position; that is, before actuation of the anchor device 18 to push the slips 22 outwardly.

A pump-back piston 142 formed on the setting mandrel 104 allows fluid pumped into a chamber 141 to move the setting mandrel 104 upwardly to move the setting mandrel 104 to its initial position, in which the spring mechanism 110 is cocked. This may be performed at the surface. Also included in the chamber 141 is a spring 140 acting against the lower surface of the piston 142. As further described below, this spring 140 is used to retract the setting mandrel 104.

A bleed-down piston 122 is attached to the outer wall of the actuator sleeve 114 against which pressure provided by a fluid (e.g., oil) in a chamber 116 is applied. An orifice 118, which provides a hydraulic delay element, is formed in an orifice adapter 126. On the other side of the orifice adapter 126, an atmospheric chamber 120 is formed inside the anchor device housing. Initially, communications between the chambers 116 and 120 through the orifice 118 is blocked. This may be accomplished by use of a rupture disc or other blocking mechanism (e.g., a seal).

Figure 2A:
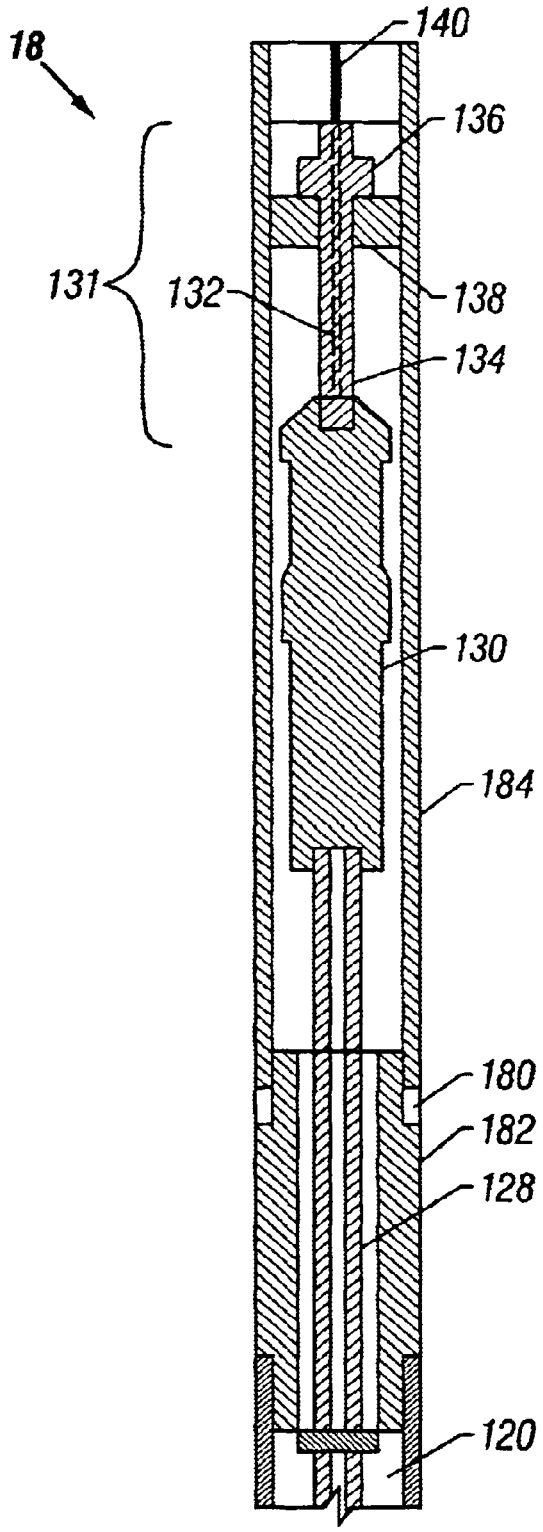
FIGS. 2A–2E illustrate an anchor device in accordance with one embodiment for use with the perforating gun string of FIG. 1.
Figure 2B:
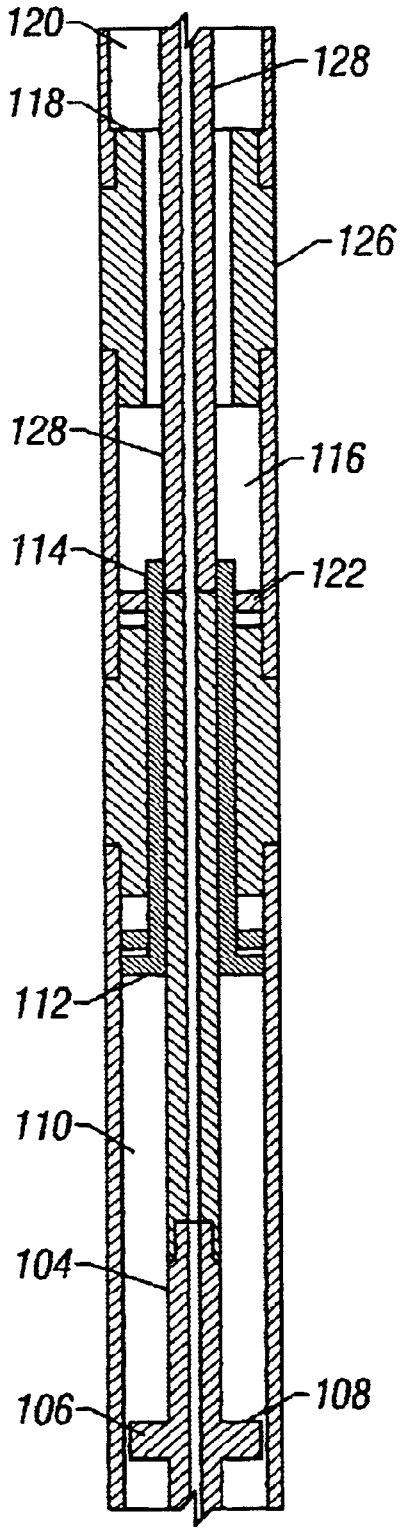

The setting mandrel 104 at its upper end is coupled to an extension rod 128, which in turn extends upwardly to connect to a fishing head 130 near the upper end of the anchor device 18 (FIG. 2A). Further, the upper end of the fishing head 130 is attached to a release assembly 131 (which is part of an actuator assembly) that includes a release bolt 134 that contains a release detonator 132. The release assembly 131 also includes a release nut 136 that maintains the position of the release bolt 134 against a release bolt bulkhead 138 that is attached to the housing of the anchor device 18. Thus, initially, when the anchor device 18 is lowered downhole in the perforating gun string 14, the setting mandrel 104 is maintained in its initial retracted position by the release assembly 131 including the release bolt 134, release nut 136, release detonator 132, and release bolt bulkhead 138. An electrical wire 140 is connected to the release detonator 132 in the release assembly 131. The electrical wire 140 may be connected to the wireline 12 that extends from the surface or to the motion transducer 25 (FIG. 1) or other electrical component in the adapter 24 connecting the non-rigid carrier 12 to the perforating gun string 14. Thus, an actuator assembly including the electrical wire 140 and the release assembly 131 allows remote operation of the anchor device 18.

In operation, to set the anchor device 18, an electrical signal is applied to the wire 140. For example, this may be a predetermined voltage of positive polarity. The electrical signal initiates the detonator 132 in the release assembly 131, which blows apart the release bolt 134 to release the fishing head 130 to allow downward movement of the extension rod 128 and the setting mandrel 104. The force to move the setting mandrel 104 downwardly is applied by the spring mechanism 110. The downward movement of the setting mandrel 104 and setting piston 102 causes translation of the engagement members 22 outwardly to engage the inner wall of the liner or tubing 11.

Once the engagement members 22 are engaged against the inner wall of the liner or tubing 11, the perforating gun string 14 can be fired (e.g., such as by applying a negative polarity voltage on the wire 140) to create perforations in the surrounding formation zone 20 (FIG. 1).

After the engagement members 22 have been set, the delay element including the orifice 118 and chambers 116 and 120 is started. Downward movement of the extension rod 128 may cause a rupture disc to rupture in the orifice 118, for example. Alternatively, movement of the extension rod 118 or setting mandrel 104 may remove a sealed connection. As a result, fluid communication is established between the chambers 116 and 120 through the orifice 118. The orifice 118 is sized small enough such that the fluid in the chamber 116 bleeds slowly into the atmospheric chamber 120. The bleed-down period provides a hydraulic delay. This hydraulic delay may be set at any desired time period, e.g., 5 minutes, 15 minutes, 30 minutes, one hour, and so forth. The delay is to give enough time for a surface operator to apply a firing signal to the perforating gun string 14. Bleeding away of fluid pressure in the chamber 116 allows the spring 140 to act against the pump-back piston 142. The spring 140 pushes the setting mandrel 104 upwardly to move the setting piston 102 upwardly to retract the engagement members 22. Thus, after a predetermined delay from the setting of the engagement members 22, the engagement members 22 are automatically retracted (presumably after actuation of the perforating gun string 14) so that the perforating guns string 14 may be removed from the wellbore 10 (or moved to another location).

The anchor device 18 in accordance with one embodiment may provide the desired anchoring using the components described above, in which the engagement members 22 are actively set (that is, set on-demand by use of actuating signals) and passively and automatically retracted (by a delay element in one embodiment).

Figure 2C:
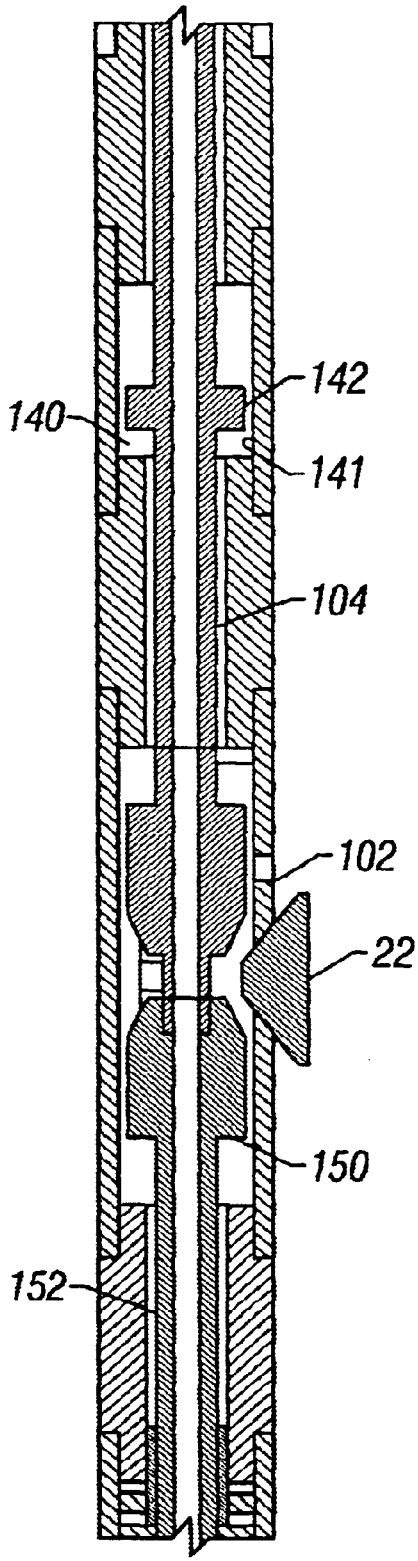

In a further embodiment, an active retracting operator (including the elements below the setting piston 102 shown in FIGS. 2C–2E) may also be provided. As shown in FIG. 2C, the retracting operator may include a retracting piston 150 and a retracting mandrel 152 that is maintained in its illustrated position during the setting operation. The retracting piston 150 is integrally attached to the retracting mandrel 152 that extends downwardly. A retraction piston 154 (FIG. 2D) is formed integrally on the outer surface of the retracting mandrel 152, against which a retracting spring mechanism 156 (or other energy source) acts. The upper end of the retracting spring mechanism 156 abuts a spring support element 158.

To move the retracting mandrel 152 and spring mechanism 156 to their initial positions, a lower pump-back piston 172 and pump-back chamber 170 are provided. At the surface, fluid may be pumped into the chamber 170 to push the retracting mandrel 152 upwardly.

Figure 2D:
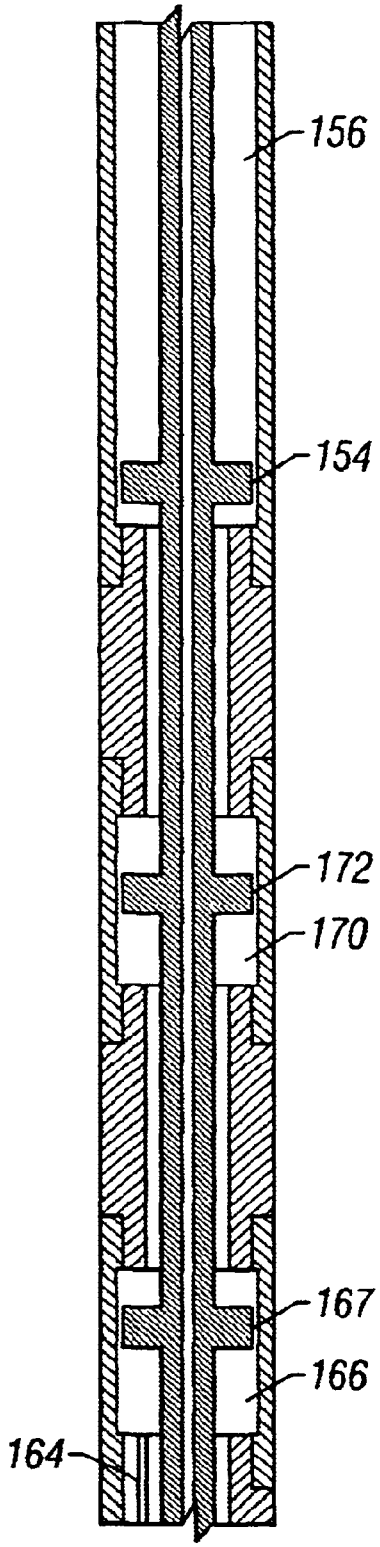
Figure 2E:
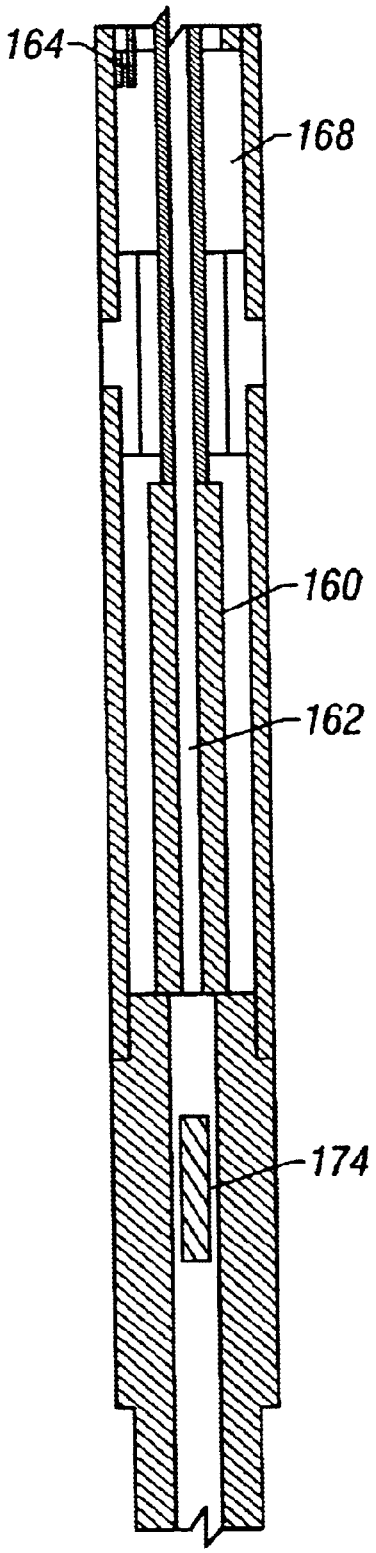
Figure 3:
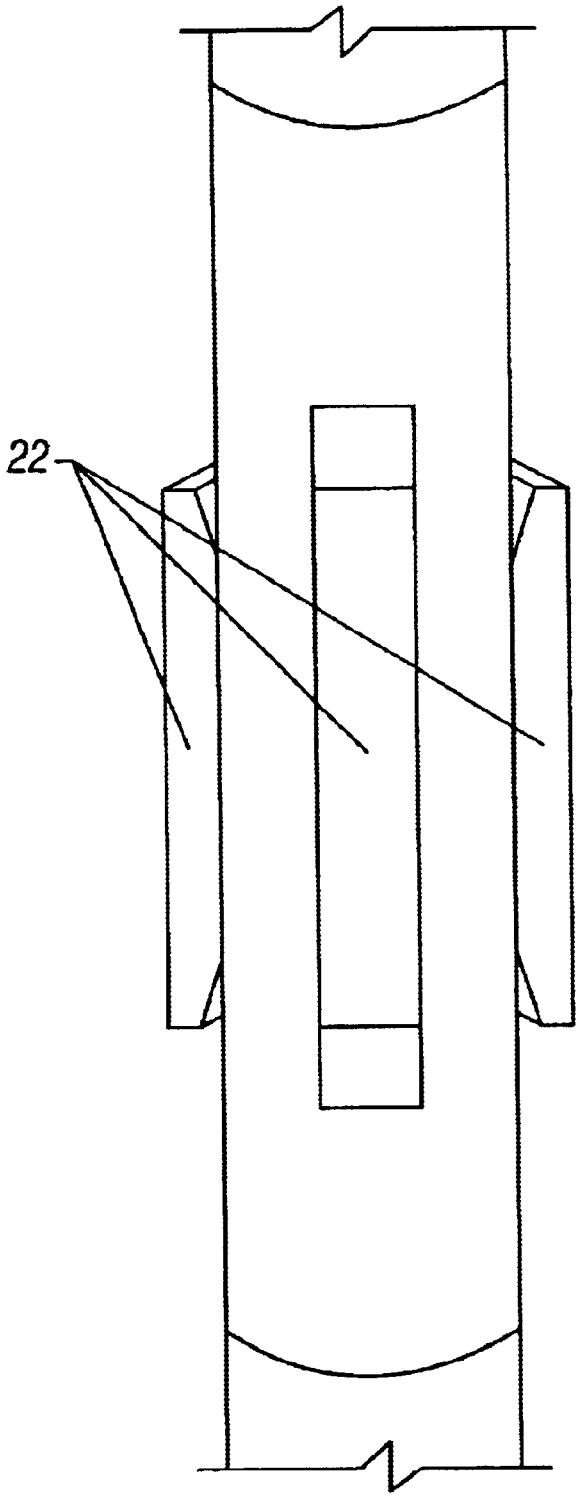
FIG. 3 illustrates engagement members in the anchor device of FIGS. 2A–2E.

After the retracting mandrel 152 is set in its initial position, downward movement of the retracting mandrel 152 is prevented by abutting the lower end of the retracting mandrel 152 against the upper end of a frangible element 160 (FIG. 2E). A detonating cord 162 extends through an inner bore of the frangible element 160. In one embodiment, the frangible element 160 may include a plurality of X-type break-up plugs. The detonating cord 162 may be the same detonating cord that is attached to shaped charges (not shown) in the perforating gun 16. Thus, when the perforating gun 16 is fired, initiation of the detonating cord (including detonating cord 162) causes the frangible element 160 to break apart so that support is no longer provided below the retracting mandrel 152.

A delay element, as shown in FIGS. 2D and 2E, includes a chamber 166 filled with fluid (e.g., oil) and an atmospheric chamber 168. An orifice 164, initially blocked by a rupture disc, seal, or other blocking element, is formed between the chambers 166 and 168. Fluid in the chamber 166 acts upwardly against a lower surface of a piston 167.

In operation, after the anchor device 18 has been set, the perforating gun 16 is fired, which causes ignition of the detonating cord 162 to break up the frangible element 160. Upon removal of the support by the frangible element 160, a downward force applied by the retracting mandrel 152 breaks a blockage element (e.g., ruptures a rupture disc) in the orifice 164. As a result, fluid communication is established between the fluid chamber 166 and the atmospheric chamber 168. As the fluid meters slowly through the orifice 164 into the chamber 168, the spring mechanism 156 applies a downward force against a lower pump-back piston 172. This moves the retracting mandrel 152 downwardly as the fluid in the chamber 166 slowly meters through the orifice 164 to the chamber 168. The delay provided by the orifice 164 may be less (e.g., five minutes or so) than the delay provided by the delay mechanism of the setting assembly. Once the fluid 166 has been communicated to the chamber 168, the retracting mandrel 152 is moved to a down position so that the engagement members 22 are retracted. Thus, in accordance with this further embodiment, a first actuation signal may be provided to set the anchor device 18, and a second signal (which may be the firing signal for the perforating gun 16) may be used to retract the engagement members 22.

In a further embodiment (referred to as the third embodiment), instead of using the signal that fires the perforating gun 16 to break up the frangible element 160, a retracting detonator 174 (FIG. 2E) may be further added in the lower part of the anchor device 18. The retracting detonator 174 is connected to the detonating cord 162 that runs into the frangible element 160. In this embodiment, after the perforating gun 16 has been fired, another electrical signal (referred to as a retracting signal) may be provided in the wire 140 to activate the detonator 174. This may be a voltage that is the reverse polarity of the signal used to fire the perforating gun 16. In the latter two embodiments that employ the retracting operator, an active set and active retract anchor device 18 is provided in which signals are provided remotely to both set and retract the anchor device 18.

Figure 4:
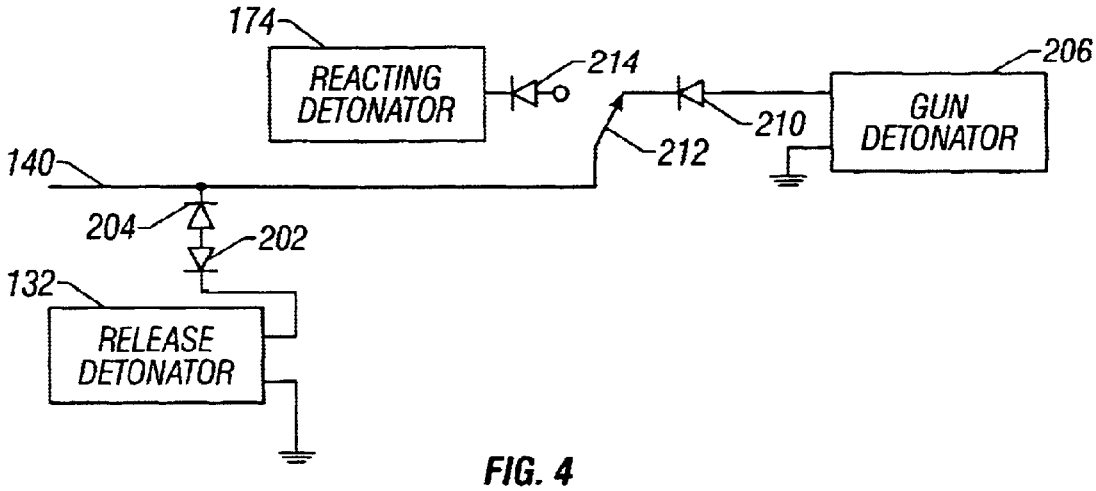
FIG. 4 is a schematic diagram of a circuit in accordance with one embodiment to set and retract the anchor device of FIGS. 2A–2E.

Referring to FIG. 4, a schematic diagram is illustrated of the circuit employed to set the anchor device 18, fire the perforating gun 16, and retract the anchor device 18 according to the third embodiment. A first positive voltage is applied to the wire 140 to activate the release bolt detonator 132 through a rectifier diode 202 and a Zener diode 204. The Zener diode 204 is used for preventing subsequent positive power (on line 140) from becoming shunted to ground should the release detonator 132 become shorted after detonation. The value of the Zener diode 204 may be selected sufficiently high (e.g., 50 volts) to prevent shunting power for subsequent initiation of the retracting detonator 174. A first positive voltage, referred to as $+V_1$, to actuate the release detonator 132 is not communicated to a perforating gun detonator since the blocking diode 210 prevents communication of positive electrical current to the gun detonator 206 and the switch 212 prevents current from reaching the retracting detonator 174. To activate the gun detonator 206, a negative voltage, referred to as $-V$, is applied on the wire 140. This causes current flow in the reverse direction through the diode 210 that is coupled to the gun detonator 206. The current flow initiates the gun detonator 206 to fire the perforating gun 16. The actuating current through a switch 212 also causes the switch 212 to flip from the normally closed position (labeled NC in FIG. 4) to the normally open position (labeled NO in FIG. 4) and to connect to the anode of a diode 214.

After the perforating gun 16 has been fired, a second positive voltage, $+V_2$ is applied on the wire 140, which causes a voltage to be applied down the wire 140 to the retracting detonator 174. As a result, application of the positive $+V_2$ causes activation of the retracting detonator 174.

In an alternative embodiment, the order of the anchor device 18 and the perforating gun 16 (FIG. 1) may be reversed, with the anchor device 18 run below the perforating gun 16. Running the anchor device 18 below the gun 16 provides the advantage that the engagement members 22 do not restrict fluid flow from the formation through the wellbore after the perforating operation.

Referring again to FIG. 2A, shear screws (or another shearing mechanism) 180 are used to attach a first anchor device housing section 182 to a second anchor device housing section 184. In case the anchor device 18 is stuck in the wellbore 10 (with the engagement members 22 set), a jarring tool (e.g., a hydraulic jarring tool) that is attached to, or part of, the perforating gun string 14 may be actuated to jar the anchor device 18 so that the shear screws 180 are sheared. This allows the housing section 184 to be lifted from the anchor device 18 so that fishing equipment may be lowered to engage the fishing head 130. The fishing equipment may include weights and a jarring device to jar upwards on the fishing head 130, which pulls the setting mandrel 104 upwardly to the retracted position so that the engagement members 22 are retracted from the liner or tubing 11.

In an alternative embodiment, instead of using spring mechanisms 110 and 156, other energy sources may be substituted for the spring mechanisms 110 and 156. For example, an alternative energy source that may be used include propellants or a grain stick or equivalent. These solid fuel packs include materials that generate pressure as they burn (after ignition). The pressure generated by ignition may cause longitudinal movement of the setting mandrel 104 or the retracting mandrel 152. Other types of energy sources include components including pressurized gas, such as gas in a chamber in the anchor device 18 or gas in a pressurized bottle positioned in the anchor device 18. The gas bottle may be pierced to allow the gas pressure to escape from the gas bottle to activate the anchor device 18. Other energy sources may include a liquid fuel that may be heated to produce pressurized gas, or a source that includes two or more chemicals that when mixed produces pressurized gas.

Figure 5:
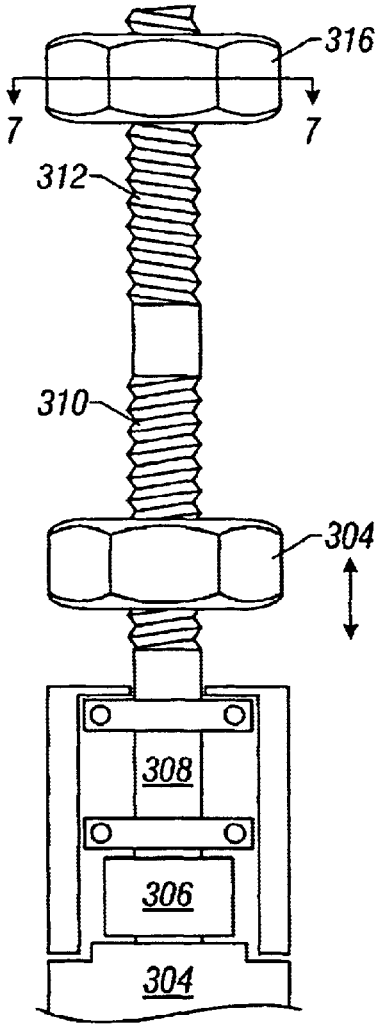
FIGS. 5–7 illustrate a motorized actuation assembly to actuate an alternative embodiment of an anchor device.
Figure 6:
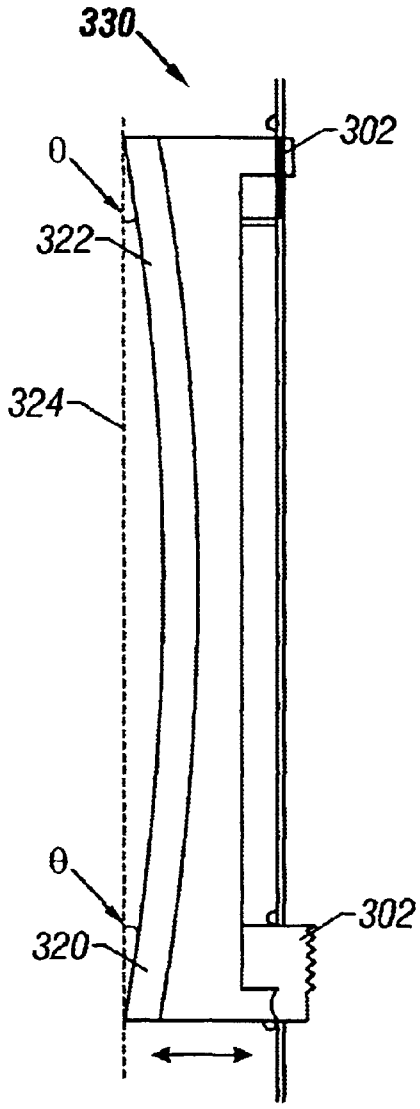
Figure 7:
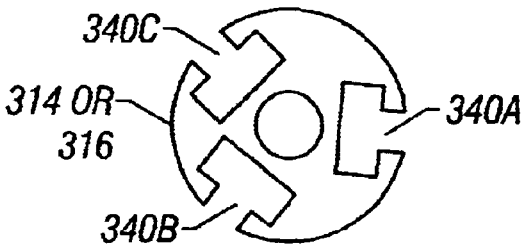

Referring further to FIGS. 5–7, an alternative embodiment of an anchor device includes a motorized assembly for actuating an engagement mechanism 330, which includes engagement members 302. In this embodiment, the setting and retracting of the engagement members 302 are accomplished by a reversible motor 304. A coupler 306 is attached to the motor 304, with the coupler 306 including a gear head that provides a predetermined gear reduction, e.g., 4,000:1. The coupler 306 is coupled to a rotatable rod 308. The rod 308 includes two sets of threads, left-hand threads 312 and right hand threads 310. Actuation nuts 314 and 316 are connected to the threads 310 and 312, respectively. Rotation of the actuation rod 308 causes longitudinal translation of the actuation nuts 314 and 316. Rotation of the rod 308 in a first rotational direction causes inward movement of the actuation nuts 314 and 316 toward each other. When the rod 308 is rotated in the reverse rotational direction, then the actuation nuts 314 and 316 translate away from each other.

As shown in FIG. 7, each actuation nut 314 or 316 includes three slots 340A–340C for engaging three corresponding engagement structures 330. Each engagement structure 330 includes angled translation structures 320 and 322 (FIG. 6) that are adapted to engage slots 340 in actuation nuts 314 and 316, respectfully. The actuation nuts 314 and 316 thus ride along the slanted structures 320 and 322 as the nuts move in and out. The first slanted structure 320 is at a first angle $\theta$ with respect to a baseline 324. The second slanted structure 322 is at the reverse angle, $-\theta$, with respect to the baseline 324. Thus, as the actuation nuts 314 and 316 move away from each other, the slip structure 330 is moved outwardly to move engagement members 302 against the inner wall of the liner or tubing 11. Movement of the actuation nuts 314 and 316 towards each other causes retraction of the engagement structure 330.

The motorized anchor device as illustrated in FIGS. 5–7 allows repeated settings and retractions. Thus, if the perforating gun string 14 includes multiple gun sections that are sequentially fired in different zones, the gun string can be set at a first zone with a first gun section fired. The anchor device can then be retracted and the gun string moved to a second zone, where a second gun section is fired. This may be repeated more times.

This embodiment lends itself to monitoring the applied force of the anchor against the liner or tubing. When working in weakened liner (because of deterioration), this feature may be highly desirable.

Some embodiments of the invention may include one or more of the following advantages. By using an anchoring device in accordance with some embodiments, displacement of a downhole tool can be prevented in the presence of applied forces from pressure surges, shocks created by firing perforating guns, and so forth. The anchor device does not block fluid flow but allows fluid to flow around the anchor. By employing the anchor device in accordance with some embodiments, a downhole tool can be set in an underbalance condition where high fluid flow rates may exist. In one application, perforating in a high underbalance condition is possible, which improves perforation characteristics since cleaning of perforations is improved due to the surge of fluid flow from the formation into the wellbore. Thus, for example an underbalance condition of between 500 to thousands of psi may be possible.

Another application of anchoring devices in accordance with some embodiments is in monobore completions. Thus, as shown in FIG. 1, the wellbore 10 can be a monobore, with the tubular structure 11 providing the functions of both a casing and a tubing. Monobore completions have many economical advantages over conventional completions. For example, reduction of the number of components in completion equipment may be achieved since the casing can be used as both production tubing and casing. However, in a monobore, one disadvantage is that pressure or fluid flow surges that may occur downhole and act on a tool string may have an increased effect since the amount of flow area around the tool string is reduced. By using the anchor device 18 in accordance with some embodiments, the tool string may be maintained in position.

Another example tool string (that replaces or adds to the perforating gun string 14 of FIG. 1) that may employ anchor devices according to some embodiments is a propellant fracturing string, which is lowered downhole adjacent a formation zone to perform gas fracturing of perforations already formed in the formation. Propellants in such a string are ignited to create high-pressure gases to extend fractures in the formation. The force resulting from the ignition of propellants may launch a propellant fracturing string up the wellbore. An anchor device in accordance with some embodiments may be employed to prevent such movement of a propellant fracturing string.

Another type of tool string that jumps when activated includes a pipe cutter string, which may be activated by explosives. An anchor device would prevent movement of the pipe cutter string when it is activated. The anchor device may also be used with any other downhole tool that may be susceptible to undesired movement due to various well conditions.

Figure 8A:
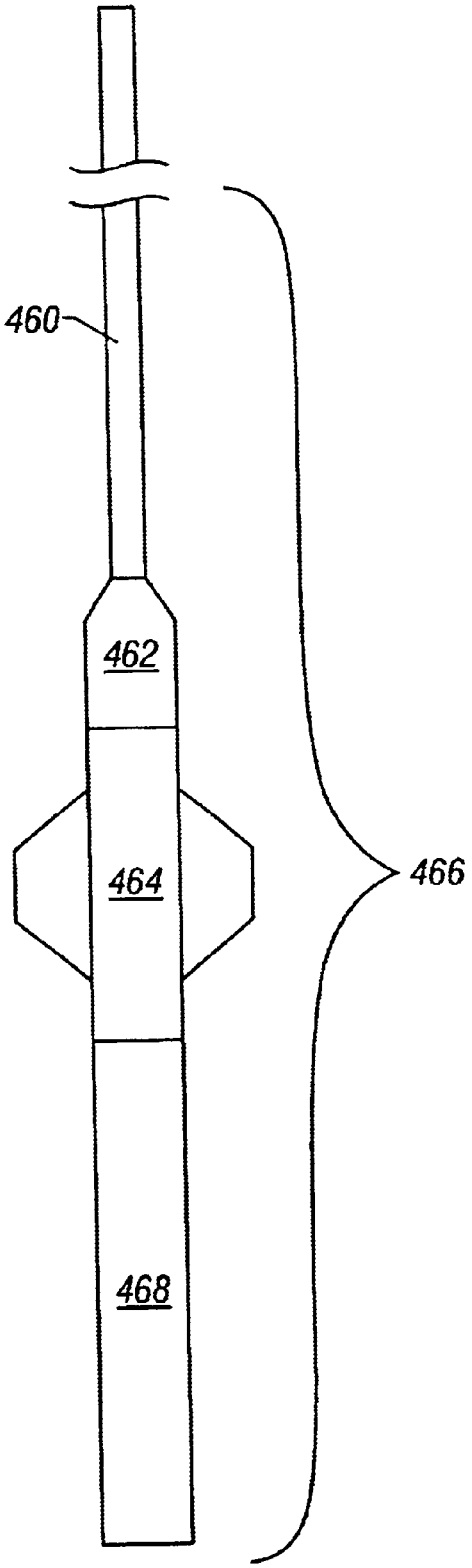
FIG. 8A illustrates use of an anchor device to protect a weak point.

Referring to FIG. 8A, the mechanical interface (such as an adapter 462) between a wireline, slickline, or other carrier line 460 and a tool 468 in a tool string 466 is typically intended to be a weak point so that downhole forces greater than a predetermined value will cause the tool 468 to break away from the carrier line 460. The elasticity of the carrier line 460 (which is a function of the length, diameter, and material of the carrier line 460) provides some protection for the weak point in the mechanical interface 462. For example, a relatively long carrier line 460 may be more elastic so that the tool string 466 may be allowed to bounce up and down when moved by pressure or flow surges without the tool string 466 breaking off at the weak point. However, with a relatively non-elastic carrier line (e.g., due to a short length, material of the line, or large line diameter), rapid movement of the tool string 466 caused by downhole forces may cause the weak point to break. To protect the weak point, an anchor device 464 in accordance with some embodiments may be employed.

Figure 8B:
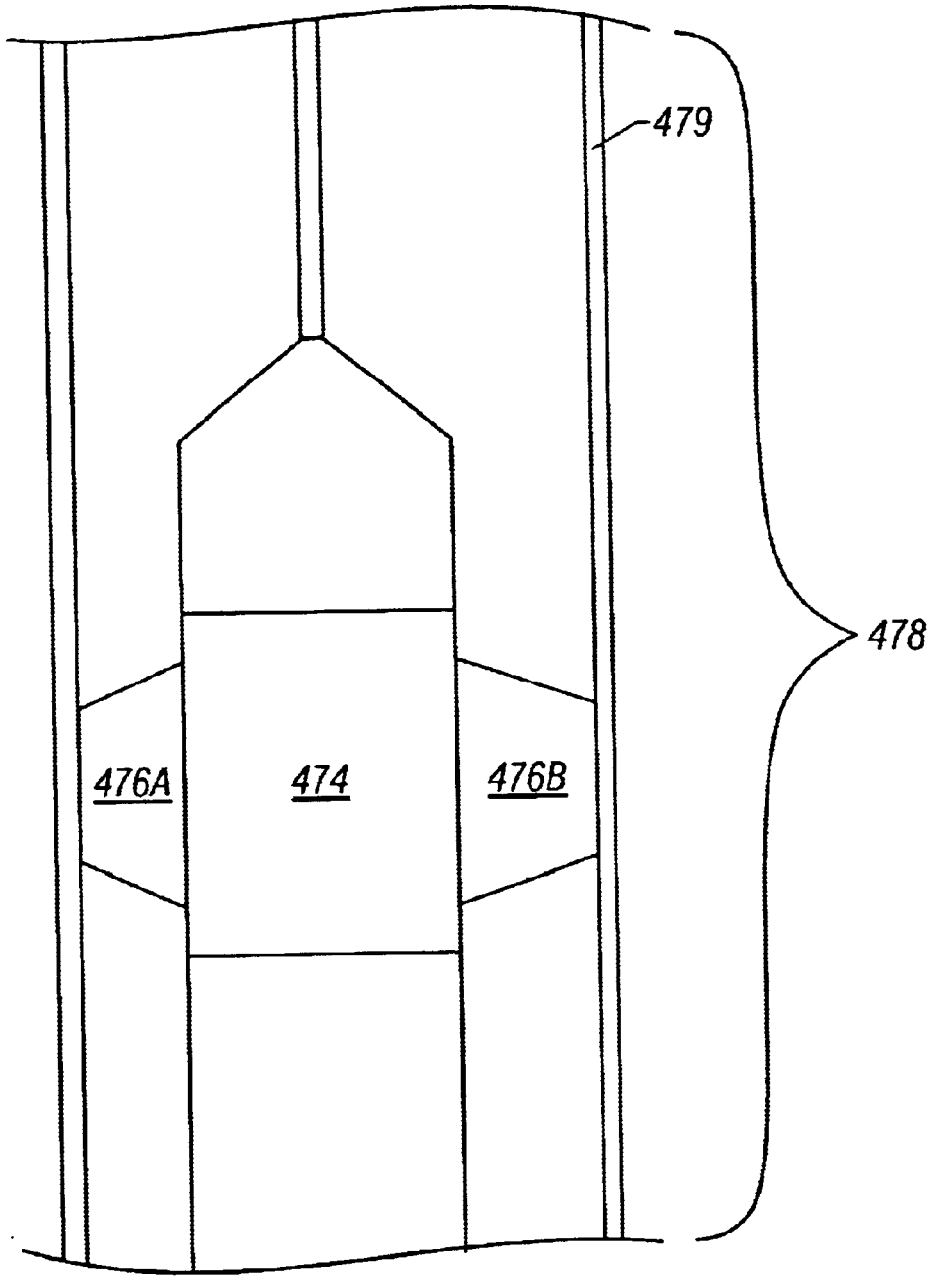
FIG. 8B illustrates use of an anchor device to centralize a tool string.

Referring to FIG. 8B, a further feature of an anchor device 474 in accordance with some embodiments is that it acts as a centralizer for a tool string 478 downhole. This is particularly advantageous for perforating strings having big hole shaped charges, which are sensitive to the amount of well fluids between the gun and the liner. A big hole charge is designed to create a relatively large hole in the liner. If a gun is decentralized, then the charge may not be able to create an intended large hole due to the presence of an increased amount of well fluids because of larger distances between the charges and liner. However, centralizing may be advantageous for other types of tools as well. As shown in FIG. 8B, the anchor device 474 in the tool string 478 employs slips 476A and 476B that extend radially outwardly by substantially the same amount to centralize the tool string 478 in a tubing or liner 479. Although two slips 476A and 476B are referred to, further embodiments may employ additional slips each extending radially outwardly by substantially the same amount to engage the tubing or liner 479.

Figure 8C:
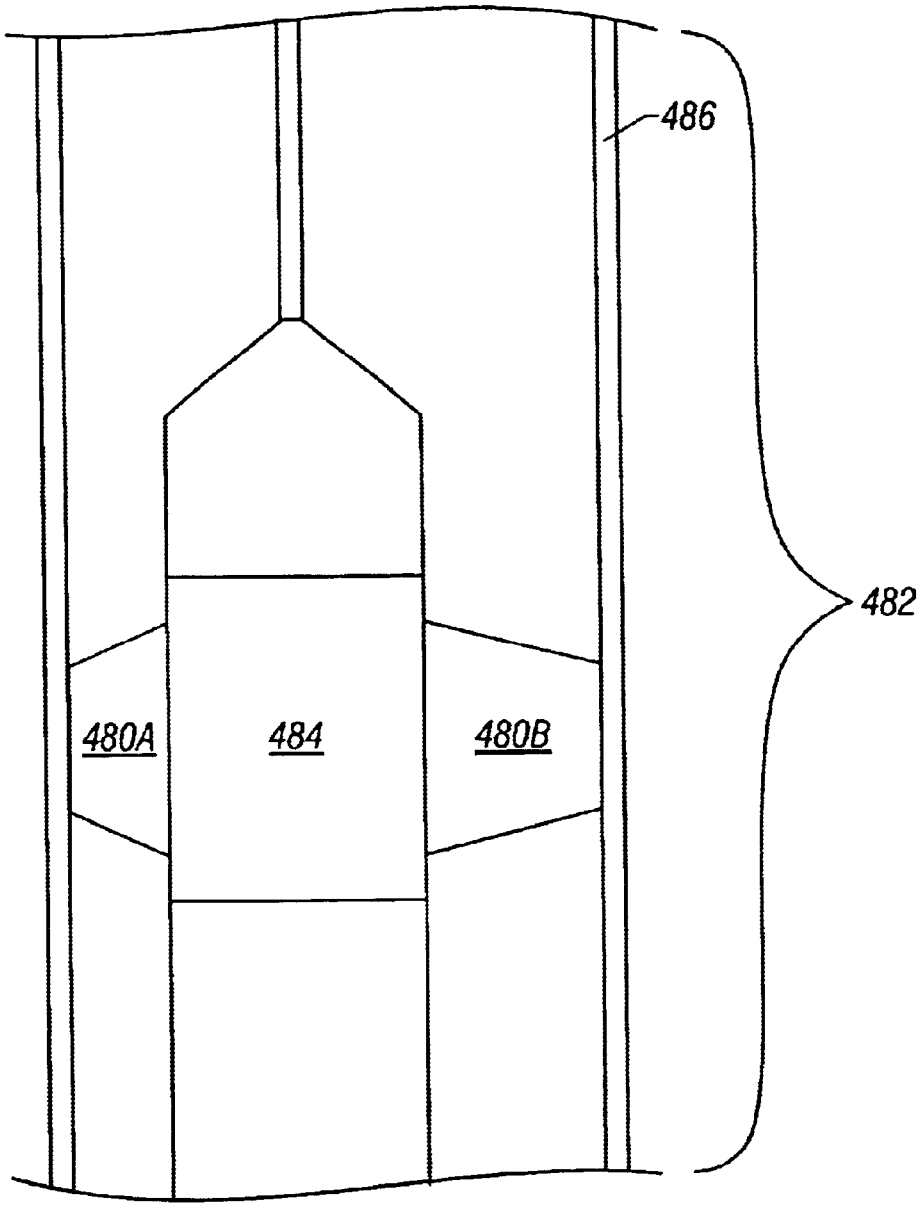
FIG. 8C illustrates use of an anchor device to place a tool string in an eccentric position.

Referring to FIG. 8C, instead of centralizing a tool string 482, an anchor device 484 according to another embodiment may eccentralize the tool string 482 (or place the tool string 482 in an eccentric position) inside a tubing or liner 486. The anchor device 484 comprises slips 480A, 480B, and so forth that extend radially outwardly by unequal distances to eccentralize the tool string 482 (or place it in an eccentric position in the wellbore). Thus, for example, the slip 480A extends radially outwardly by a first distance, while the slip 480B extends radially outwardly by a second, greater distance. As a result, one side of the tool string 482 is closer to the inner surface of the tubing or liner 486 than the other side.

Figure 8D:
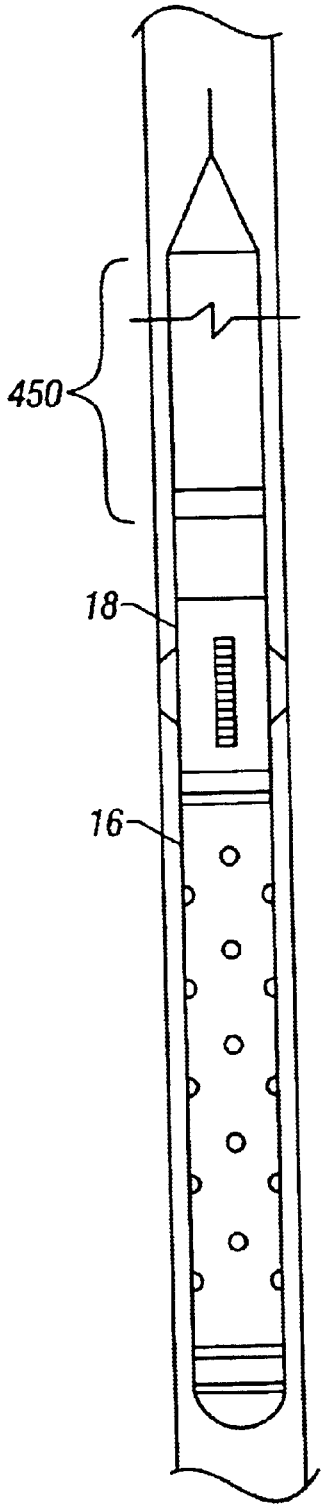
FIG. 8D illustrates use of an anchor device to protect instruments in a perforating gun string.

Another feature of an anchor device in accordance with some embodiments is that it provides shock protection for instruments coupled in the same string as a perforating gun. Referring to FIG. 8D, a string including the perforating gun 16 may also include other instruments, such as a gamma ray tool, a gyroscope, an inclinometer, and other instruments that are sensitive to shock created by the perforating gun 16. Once set against the liner or tubing, the anchor device 18 is capable of dissipating pyro shock created by firing of the perforating gun 16 into the surrounding liner, which removes a substantial amount of shock from reaching the instruments 450. Thus, by using the anchor device 18, shock protection is provided to sensitive instruments, which may be relatively expensive.

Another application of an anchor device in accordance with some embodiments is in "extreme" overbalance conditions, in which nitrogen gas is pumped into a wellbore to create a high-pressure environment in a portion of the wellbore. When a perforating gun is fired to create perforations into the wellbore, the high pressure provided by the nitrogen gas enhances fractures created in the formation. To allow the perforating gun to be set in such an overbalance condition, an anchor device in accordance with some embodiments may be employed. A perforating gun string including an anchor device is lowered into the wellbore and the anchor device set to position the perforating gun string next to a target zone. Next, nitrogen gas is pumped into the wellbore to increase the wellbore pressure to create the overbalance condition. The perforating gun is then fired to perform the perforating and fracturing operation. Once the pressure is equalized between the wellbore and formation, the anchor device is retracted.

Figure 9A:
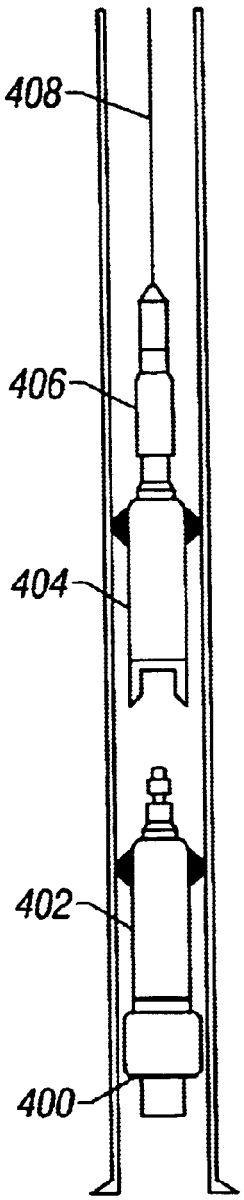
FIGS. 9A–9B illustrate a conventional gun stack system.
Figure 9B:
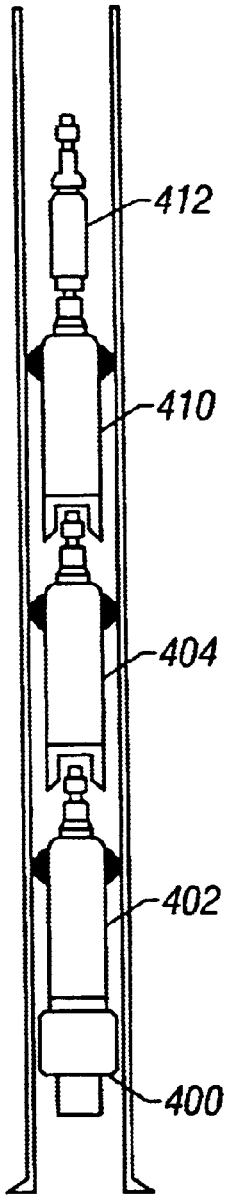

Referring to FIGS. 9A–9B, a conventional gun stack system is illustrated. As shown in FIG. 9A, a first gun section 402 attached to a conventional anchor 400 is positioned in a wellbore. After the anchor 400 is set, the next gun section 404 is lowered by a running tool 406 (attached on a wireline 408) into the wellbore and stacked on top of first gun section 402. As shown in FIG. 9B, a third gun section 410 may also be stacked over the second gun section 404. In one conventional configuration, the gun sections 402, 404, and 410 are ballistically connected but not fixedly attached (that is, a connection is not provided to prevent axial movement of the gun sections 502, 504, and 506). Next, a firing head 412 is lowered into the wellbore and connected to the third gun section 410. The firing head 412 may be actuated to fire the gun sections 410, 404, and 402. One disadvantage of such a gun stack system, however, is that the force occurring from firing of the guns may cause the gun sections 404 and 410 to jump upwardly since the gun sections 404 and 410 are not fixedly attached to the first gun section 402 and anchor 400.

Figures 10A, 10B, 10C:
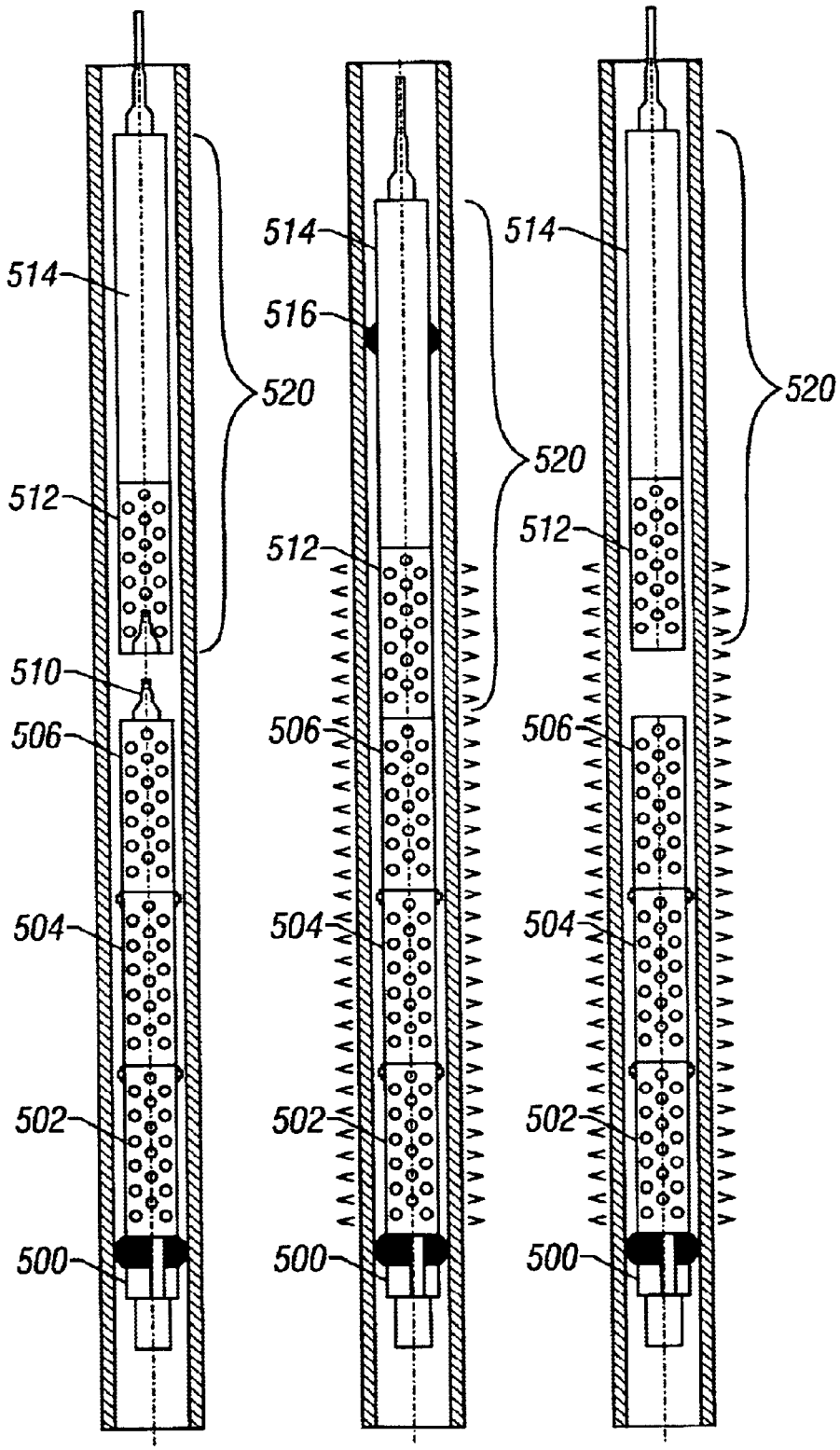
FIGS. 10A–10C illustrate a gun stack system including an anchor device in accordance with some embodiments.

Referring to FIGS. 10A–10C, to solve this problem (without having to fixedly attach the gun sections, which may be complicated), a gun stack system that employs an anchor device in accordance with some embodiments may be employed. As shown in FIG. 10A, a stack system initially includes three (or some other number of) gun sections 502–506. The lowermost or distal gun section 502 is connected to a "generic" or conventional anchor 500. The gun sections 502, 504 and 506 are not fixedly attached to each other, that is, the gun sections 504 and 506 may be moved axially away from the gun section 502. Another gun section 512 (the proximal gun section) that is attached to an anchor device 514 in accordance with some embodiments may be lowered on a wireline or slickline. A ballistic transfer element 510 is adapted to couple to the bottom portion of the gun section 512 so that the gun sections 512, 506, 504, and 502 are ballistically connected.

Next, as shown in FIG. 10B, the anchor device 514 is set using techniques described above to set engagement members 516 against the liner. After the anchor device 514 is set, a firing signal can be transmitted over the wireline or slickline (electrical signal or motion signal) to fire the gun sections 512, 510, 504, and 502. Because the anchor 500 and the anchor device 514 are set, movement of the gun sections 502, 504, 506, and 512 is prevented. After firing, the anchor device 514 is retracted and the anchored gun string 520 may be removed from the wellbore, as illustrated in FIG. 10C.

Referring to FIGS. 11A–11E, an anchoring device 600 according to an alternative embodiment includes a power piston 612 that is actuatable by fluid pressure, such as well fluid pressure. The power piston 612 (FIG. 11B) includes a first shoulder surface 621 exposed to an annular chamber 626 adapted to receive well fluids through ports 610 from outside the anchoring device 600. The chamber 626 is defined between a power piston housing 615 and the power piston 612. The shoulder surface 621 has a first area, referred to as A1, against which the well fluid pressure can act. The ports 610 are formed in the power piston housing 615. O-ring seals 620, 622, and 624 isolate portions of the anchor device 600 above and below the chamber 626. Above the O-ring seal 622 is another shoulder 641 formed in the power piston 612. The surface area of the shoulder 641 has an area A2. In the initial unset position as illustrated, the O-ring seal 622 prevents fluid pressure from being communicated to the shoulder 641 so that the force applied against the power piston 612 is applied primarily on the shoulder 621.

Figure 11A:
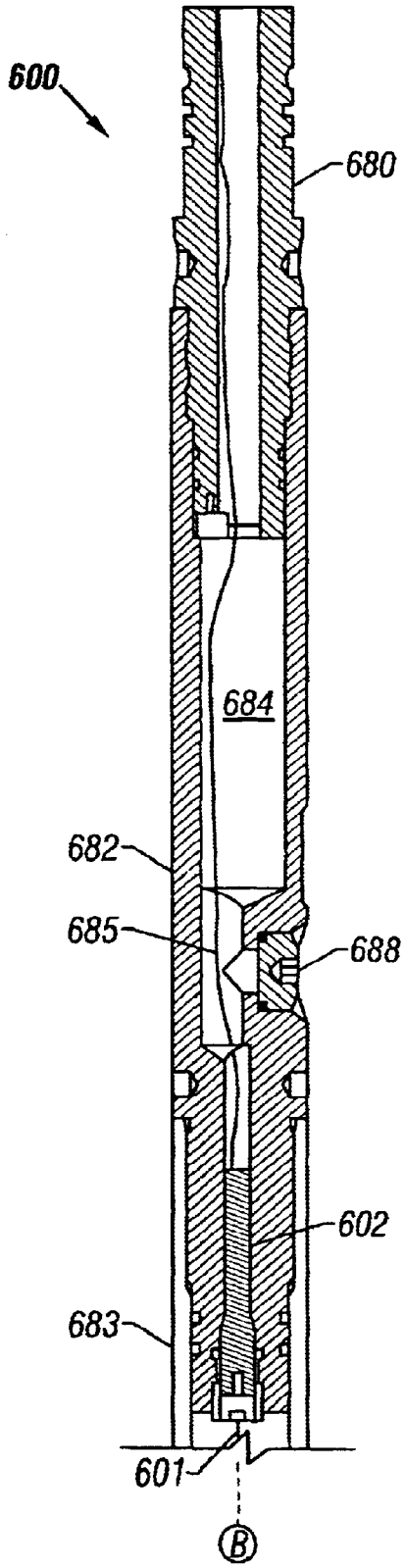
FIGS. 11A–11E illustrate an anchor device in accordance with another embodiment.
Figure 11B:
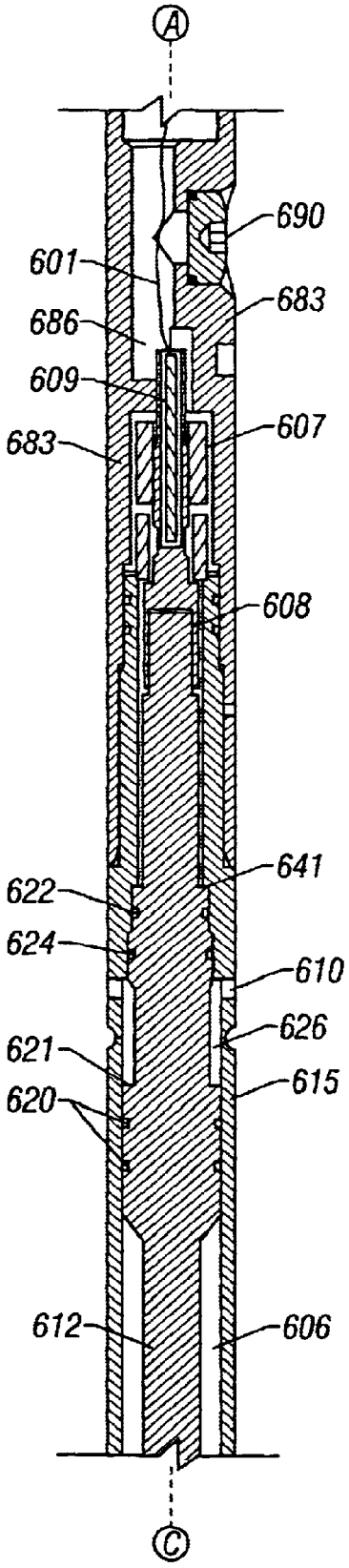
Figure 11C:
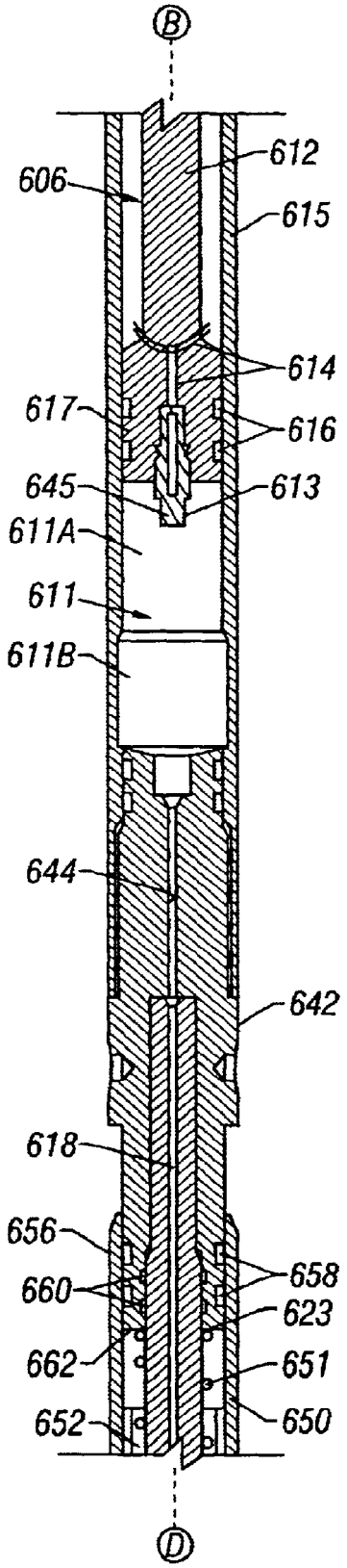

The upper portion of the power piston 612 is attached to a release bolt 608, which is in turn connected to a retaining nut 607 to maintain the power piston in its initial unset position (as illustrated). Inside the release bolt 608 is a cavity to receive a release detonator 609. The release detonator 609 is attached by electrical wires 601 to a dual diode device 602 (FIG. 11A). The dual diode device 602 is in turn coupled by electrical wires 685 extending through the upper portion of the anchor device 600. An activation signal can be provided down the electrical wires 685 to the dual diode device 602, which in turn provides an electrical signal over the wires 601 to detonate the detonator 609. Detonation of the detonator 609 breaks apart the release bolt 608 to release the power piston 612.

As illustrated, the release assembly including the release bolt 608, retaining nut 607, and detonator 607 is contained in a housing section 683. In further embodiments, other types of release mechanisms may be employed. The dual diode device 602 is located in a bore of another housing section 682 that is coupled to the housing section 683. An upper adapter 680 is attached to the housing section 682 and may be connected to a downhole tool (such as a perforating gun string) above the anchoring device 600. In another arrangement, the downhole tool may be connected below the anchoring device 600.

Electrical wires 685 extend inside a chamber 684 defined in the housing section 682 to the dual diode device 602. A second chamber 686 is defined in the housing section 683 through which electrical wires 601 connecting the dual diode device 602 and the detonator 609 may be routed. Caps 688 and 690 may be fitted into openings in the housing sections 682 and 683, respectively. At the surface, the cap 688 may be removed from the housing section 682 to allow wiring in the chamber 684 to be "made up," in which wiring extending through the upper portion of the anchoring device 600 may be contacted to wiring connected to the dual diode device 602. Similarly, in the chamber 686, wiring from the dual diode device 602 and wiring from the detonator 609 can be made up through the opening in the housing section 683. The caps 688 and 690 also provide bleed ports through which pressure may bleed off if pressure builds up inside the chambers 684 and 686, respectively.

The lower portion 617 (FIG. 11C) of the power piston 612 is attached to a hydraulic delay element 613, which may be a device including a slow-bleed orifice. The slow-bleed orifice 613 may include a porous member 645 through which fluid may meter through at a predetermined rate. The slow-bleed orifice is in communication with a chamber 611 that contains a fluid, such as oil. Fluid in the chamber 611 is also in contact with the bottom surface of the power piston 612. O-ring seals 616 around the lower portion 617 of the power piston 612 maintains separation of the fluid in the chamber 611 from an atmospheric chamber 606 defined between the power piston 612 and the inner wall of the power piston housing 615. The chamber 611 includes a first portion 611A and a second portion 611B. The second portion 611B has a larger diameter than the first portion 611A. The enlarged diameter of the second portion 611B allows clearance in the chamber 611 around the seals 616 in the power piston lower portion 617 so that fluid in the chamber 611 can flow around the seals 616 into the atmospheric chamber 606 when the power piston lower portion 617 moves into the second chamber portion 611B.

Figure 11D:
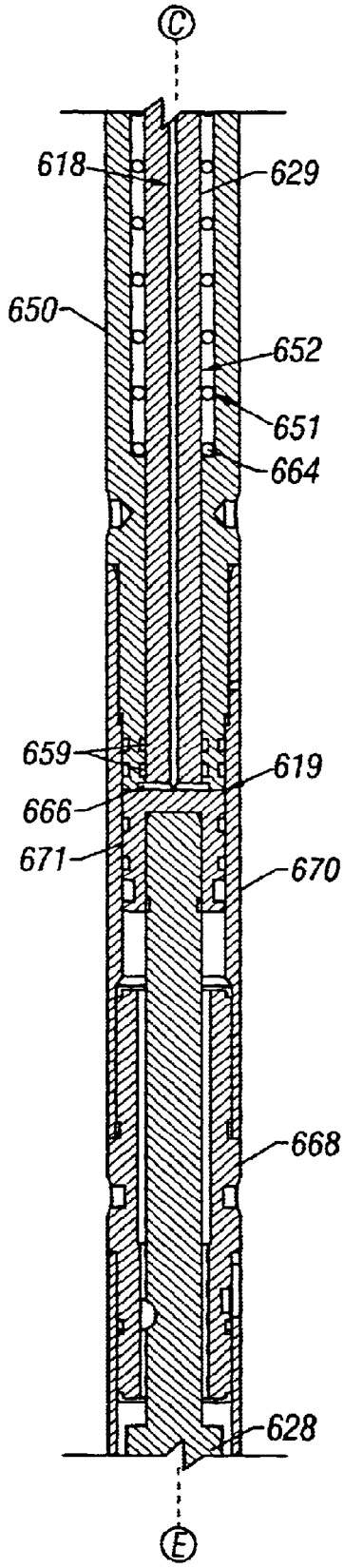

The power piston housing 615 is attached to an adapter 642, which includes a channel 644 that provides a fluid path from the chamber 611 to a channel 618 in a piston rod 629 (FIG. 11D). The channel 618 extends along the entire length of the piston rod 629 and terminates at a chamber 666 (FIG. 11D) below the piston rod 629. The upper portion of the piston rod 629 is attached to the adapter 642. Although the illustrated embodiment of the anchor device includes a number of adapters and housing sections, a smaller or larger number of sections may be used in anchor devices according to further embodiments.

The piston rod 629 also extends inside an actuating housing 650 that is axially movable with respect to the adapter 642. The inner surface of the upper portion 656 of the actuating housing 650 is in abutment with the outer surface of the lower portion of the adapter 642. O-ring seals 660 provide isolation between the outside of the anchoring device 600 and a spring chamber 652 defined between the actuating housing 650 and the piston rod 629. In one embodiment, the spring chamber 652 may be filled with air or other suitable fluid. The air in the chamber 652 is sealed in by O-ring seals 658 as well as O-ring seals 660 and 659.

A retract spring 651 is located in the spring chamber 652. The retract spring 651 pushes against a lower surface 623 of the intermediate housing 642 and a shoulder surface 664 inside the actuating housing 650.

Fluid pressure in the chamber 666 acts against a lower surface 619 of the actuating housing 650. The force on the surface 619 generated by pressure in the chamber 666 is designed to overcome the force of the retract spring 651 and the air pressure in the spring chamber 652 to move the actuating housing 650 upwardly.

Figure 11E:
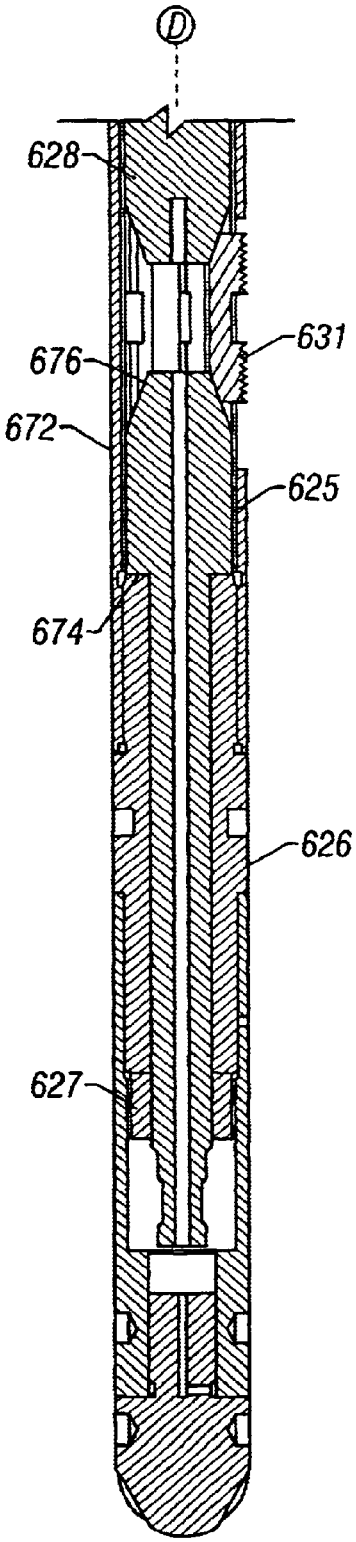
Figure 12A:
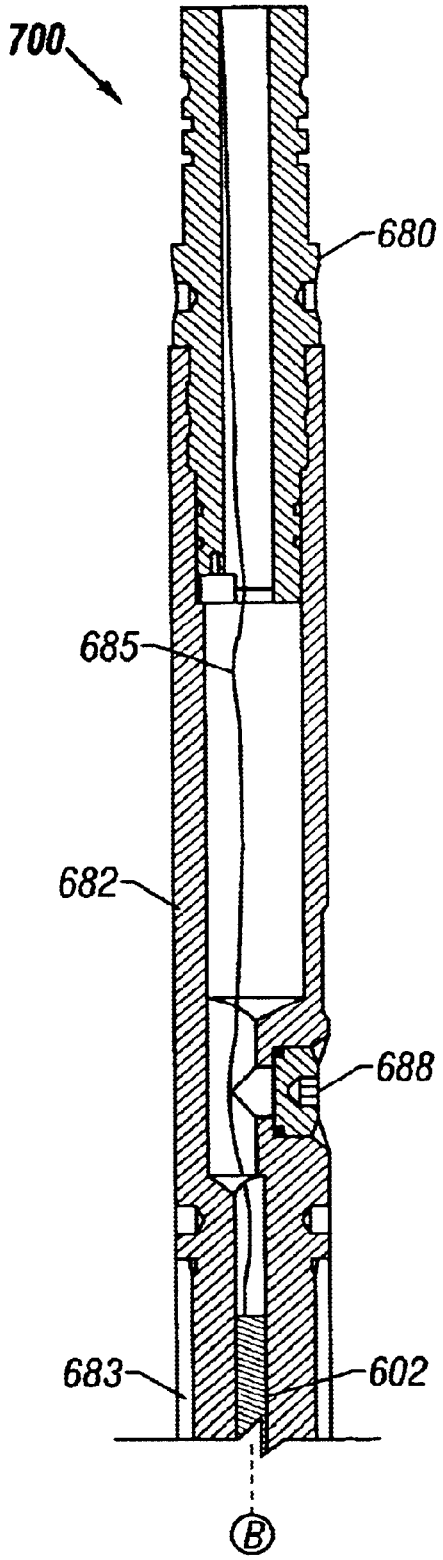
FIGS. 12A–12F illustrate an anchor device in accordance with a further embodiment.
Figure 12B:
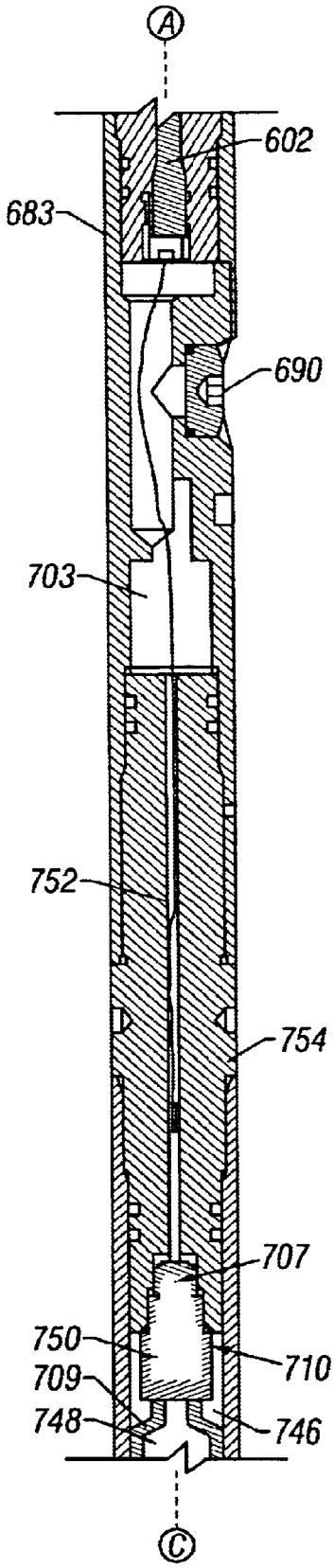
Figure 12C:
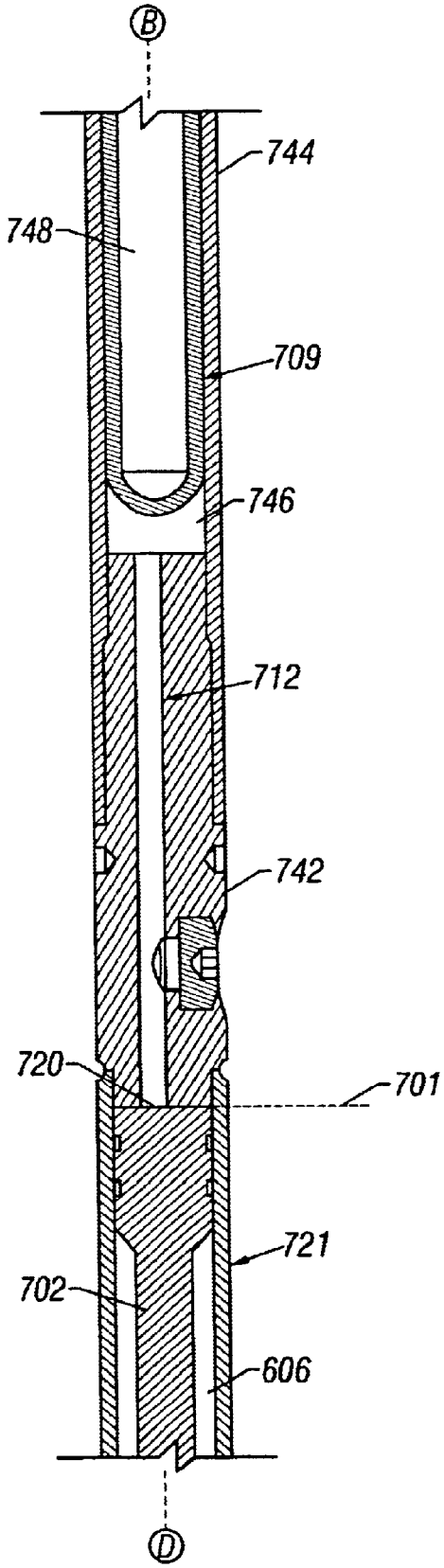
Figure 12D:
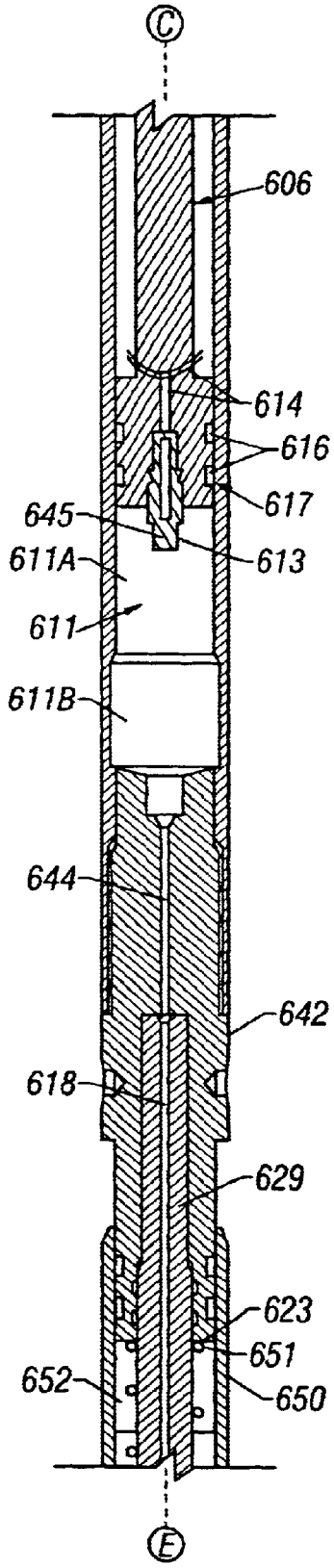
Figure 12E:
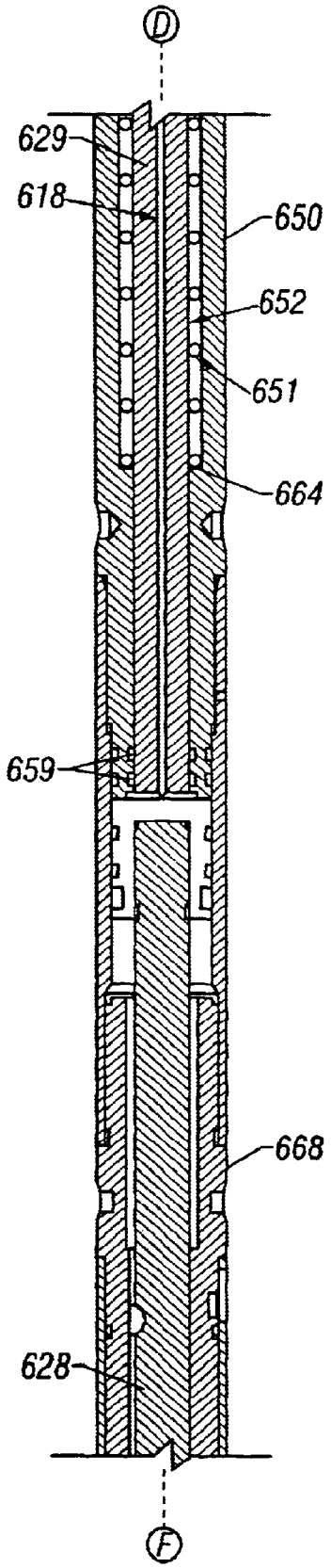
Figure 12F:
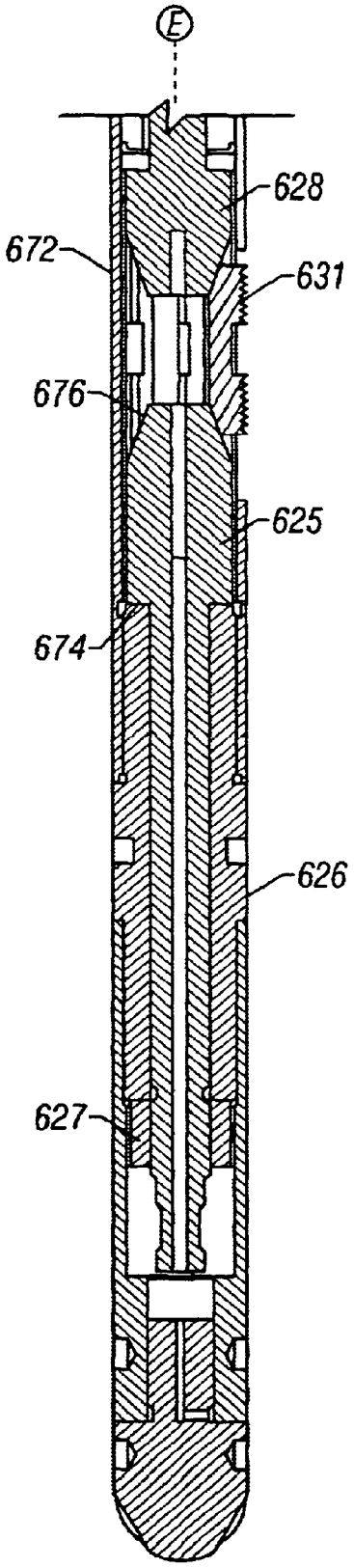

The actuating housing 650 is connected to a series of connected housing sections 668, 670, and 672 (FIGS. 11D and 11E). The housing sections 668, 670, and 672 move upwardly along with upward movement of the actuating housing 650. The lower most housing section 672 is connected to an adapter 626 whose upper end is in abutment with an actuating shoulder 674 provided by a lower actuating wedge 625. The actuating wedge 625 is fixed against the adapter 626 by locking nut 627. Upward movement of the lower housing section 672 and adapter 626 pushes upwardly on the actuating shoulder 674 of the lower actuating wedge 625. An angled surface 676 on the upper end of the lower actuating wedge 625 is adapted to push against a corresponding slanted surface of a slip 631 to move the slip 631 outwardly to a set position. The slip 631 is adapted to engage the inner wall of a liner.

A stationary upper wedge 628 has an angled surface that is in abutment with the opposing slanted surface of the slip 631. Upward movement of the lower actuating wedge 625 towards the upper wedge 628 pushes the slip 631 outwardly.

In operation, once the anchoring device 600 is lowered downhole, well fluid pressure is communicated through ports 610 into the chamber 626 to act against the shoulder surface 621 of the power piston 612. An electrical signal can then be communicated to the detonator 609 to shatter the release bolt 608, which releases the power piston 612 to allow downward movement of the power piston 612 by the well fluid pressure acting against the shoulder surface 621. Once the power piston 612 has moved a certain distance, the seal 622 clears the ports 610 to allow well fluid pressure to act against the second shoulder surface 641 (having surface area A2) of the power piston 612. In effect, the downward force on the power piston 612 is contributed by pressure acting against the shoulder 621 (having surface area A1) and the second shoulder surface 641 (having surface area A2) to provide a larger downward force on the power piston 612. The two levels of actuating surfaces are provided to reduce stress on the release bolt 608 when the anchor device 600 is in its initial unset position. By providing a reduced surface area against which wellbore fluids pressure can act, a reduced downward force is applied against the power piston 612 as the anchor device 18 is lowered downhole.

The downward force applied on the power piston 612 causes fluid to start metering through the slow-bleed orifice 613. The fluid in the chamber 611 slowly meters through the porous member 645 and the passages 614 into the atmospheric chamber 606. The slow-bleed orifice 613 may be designed to provide a predetermined delay during which actuation of a perforating gun (or other downhole tool) connected above the anchoring device 600 may be performed. The downward force applied by the power piston 612 exerts a pressure against the fluid in the chamber 611, which is communicated through channels 644 and 618 to the chamber 666, which in turn is communicated to the lower surface 619 of the actuating housing 650. This pushes the actuating housing 650 upwardly to move the actuating housing 650 upwardly, which compresses the retract spring 651. Upward movement of the actuating housing 650 causes the lower actuating wedge 625 to move the slip 631 outwardly to a set position. A relatively steady pressure is applied against the lower surface 619 of the actuating housing 650 to maintain the anchor device 600 in its set position.

The fluid in the chamber 611 continues to meter through the slow-bleed orifice 613 into the atmospheric chamber 606. As this happens, the power piston 612 continues to move downwardly in the chamber 611. When the lower portion 617 of the power piston 612 moves into the second chamber portion 611B having the increased diameter, clearance is provided between the inner wall of the second housing portion 611B and the seals 616 to allow the remainder of the fluid in the chamber 611 to quickly flow into the atmospheric chamber 606. This removes pressure applied against the lower surface 619 of the actuating housing 650, which then allows the spring 651 to apply a downward force against the actuating housing 650. This moves the actuating housing 650 downwardly to move the lower actuating wedge 625 downwardly to retract the slip 631. An automatic retraction is this provided after a predetermined delay set by the delay element.

Thus, more generally, a mechanism is provided that provides a predetermined delay period after a tool component is set to automatically retract or release the tool component. The tool component can be a component other than the slip 631 described. The predetermined delay period may be set at the well surface by operators, which may be done by selecting a hydraulic delay element having the desired delay.

Another feature of the anchor device 600 in accordance with some embodiments is the ability to "fish" or retrieve the anchor device 600 in case the slip 631 becomes stuck for some reason. The upper wedge 628, which is normally stationary, is connected by several components to the upper end of the anchor device 600. As illustrated in FIG. 11D, the upper end of the wedge 628 is connected by a nut 671 to the piston rod 629. Further, up the chain, the piston rod 629 is connected to the adapter 642 (FIG. 11C), which is connected to the power piston housing 615, which is connected to the housing section 683 (FIG. 11B), which is connected to the housing section 682 (FIG. 11A), and which is connected to the adapter 680.

If the anchor device 600 becomes stuck, a jarring device may be lowered into the wellbore to jar the string including the downhole tool and anchor device 600. When jarred upwardly, the assembly including the upper wedge 628, piston rod 629, adapter 642, housing sections 615, 683, and 682, and adapter 680 are moved upwardly with respect to the housing section 672. Since the upper wedge 628 and slip 631 are connected by a dovetail connection, the upward movement of the upper wedge 628 retracts the slip 631.

Referring to FIGS. 12A–12F, an anchoring device 700 in accordance with another embodiment is illustrated. The portion of the anchoring device 700 beneath the line indicated as 701 is identical to the corresponding section of the anchoring device 600. However, in accordance with this alternative embodiment, an alternative source of energy is used to actuate the anchoring device 700.

In this embodiment, power piston 702 (FIGS. 12C and 12D) is similar to the power piston 612 in FIGS. 11A–11E but is truncated at the line 701. The power piston housing 721 is also similar to the power piston housing 615 of the device 600 except it is modified above the line 701. The upper surface 720 of the power piston 702 is in communications with a passage 712 defined in an adapter 742. The adapter 742 is attached to a housing portion 744 that houses a chamber 746 in communications with the passage 712. A gas bottle 709 may be positioned inside the chamber 746. The gas bottle 709 includes an inner cavity 748 that is filled with a gas at a predetermined pressure (e.g., 3,800 psi). The gas in the bottle 709 may be set at other pressures in further embodiments. The gas may be some type of a non-flammable or inert gas, such as nitrogen. A cap 710 (FIG. 12B) covers the upper end of the bottle 709 to seal the gas inside the cavity 748 of the gas bottle 709. A puncturing device 707 is provided above the cap 710. The puncturing device, which is activable electrically, may include a puncturing pin. When activated, the puncturing device 707 is designed to puncture a hole through the cap 710 to allow gas in the bottle 709 to escape through ports 750 into the chamber 746. The gas pressure in the chamber 746 is communicated down the passage 712 to the upper end of the power piston 702.

The puncturing device 707 may be activated by an electrical signal sent over electrical wires 703 routed through a passage 752 defined in an adapter 754 that is connected to the housing 744. The electrical wires run to the dual diode device 602, which is the same device used in the anchor device 600 of FIGS. 11A–11E. In addition, the upper portion of the anchor device 700 is the same as the upper portion of the anchor device 600.

Instead of the puncturing device 707, other mechanisms to control communications of the gas pressure in the bottle 709 to the power piston 702 may also be used. For example, a solenoid valve that is electrically controllable may be used. Other types of valves may also be used, as may other types of mechanisms for opening the bottle 709.

In operation, once the anchor device 700 is lowered to a desired depth, an electrical signal is sent down the electrical wires 685 to the diode device 602, which in turn activates a signal down electrical wires 703 to the puncturing device 707. The puncturing device 707 in turn punctures a hole through the cap 710 to allow pressurized gas to escape the bottle 709 through ports 750 into the chamber 746. The pressurized gas is communicated to the upper end of the power piston 702, which is moved downwardly by the applied force. Downward movement of the power piston 702 causes fluid in the chamber 611 to start metering through the delay element 613 into the atmospheric chamber 606. At the same time, the applied pressure against the fluid in the chamber 611 causes movement of the actuating housing 650 to set the anchor slip 631, as described above in connection with FIGS. 11A–11E. Once the lower portion of the power piston 702 moves into the second housing portion 611B, clearance around the seals 616 allows fluid in the chamber 611 to escape into the atmospheric chamber 606, thereby removing pressure from the actuating housing 650. This allows the spring 651 to push downwardly on the actuating housing 650 to automatically retract the slip 631.

In a variation of the anchor device 700, a gas chamber defined in the housing of the device may be employed without the gas bottle 709. Gas may be pumped into the gas chamber at the well surface and set to a predetermined pressure. The pressurized gas in the gas chamber may be in communications with the power piston 702. To maintain the power piston in an initial unset position, a release assembly similar to that used in the anchor device 600 of FIGS. 11A–11E may be employed. Further, instead of gas, a pressurized liquid may also be employed. In other embodiments, a motor located downhole may be used to activate a pump to deliver the desired pressure. Other mechanisms (hydraulic, mechanical, or electrical) may also be employed to deliver the desired force. Further, energetic materials may be employed that transform one type of energy (e.g., heat) into another form of energy (e.g., pressure). Examples of this include a thermite or propellant that can be initiated to provide heat energy, which may be used to burn another element that outgases upon burning to produce high pressure.

Figure 13:
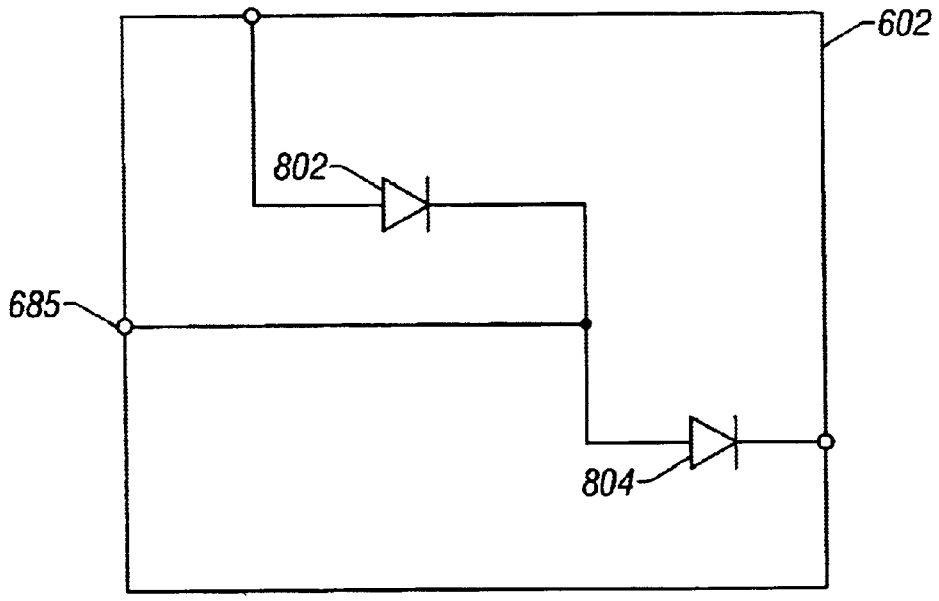
FIG. 13 is a circuit diagram of a dual plug device for use in the anchor devices of FIGS. 11A–11E and 12A–12F.

Referring to FIG. 13, the dual diode device 602 includes two diodes 802 and 804. The anode of the diode 804 is connected to the wire 685. When a positive voltage is received over the wire 685, the diode 804 turns on to conduct current to the detonator or puncturing device. However, because the cathode of the diode 802 is connected to the wire 685, the positive voltage does not turn on the diode 802. Next, the polarity on the wire 685 may be reversed to cause diode 802 to conduct and to turn off the diode 804. A negative activation signal is then provided through the diode 802 to the gun.

Figure 14A:
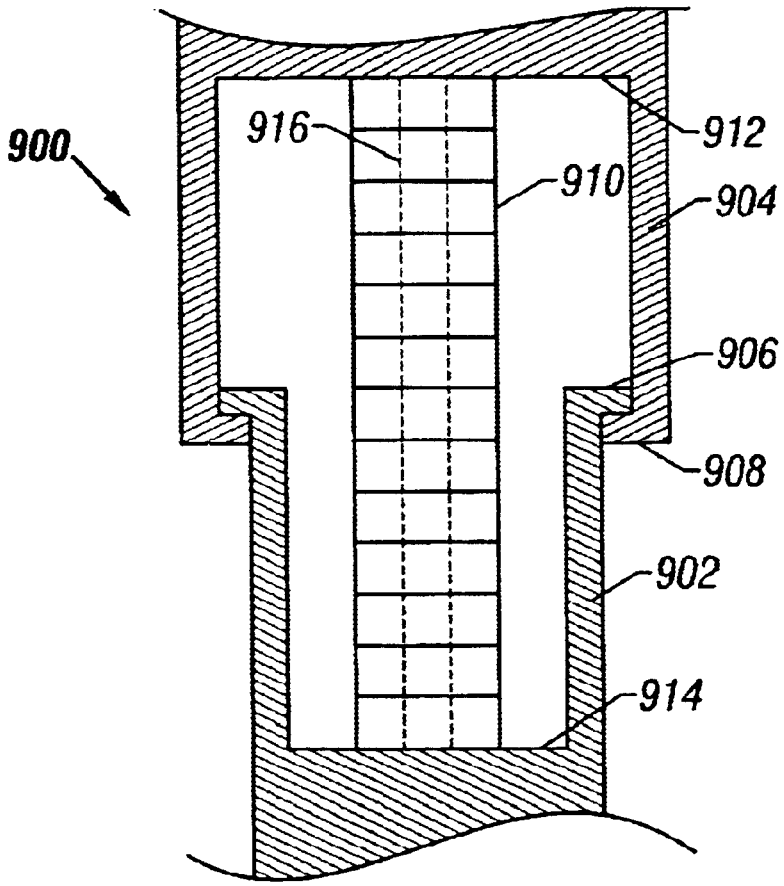
FIGS. 14A–14C illustrate jarring mechanisms in accordance with various embodiments.
Figure 14B:
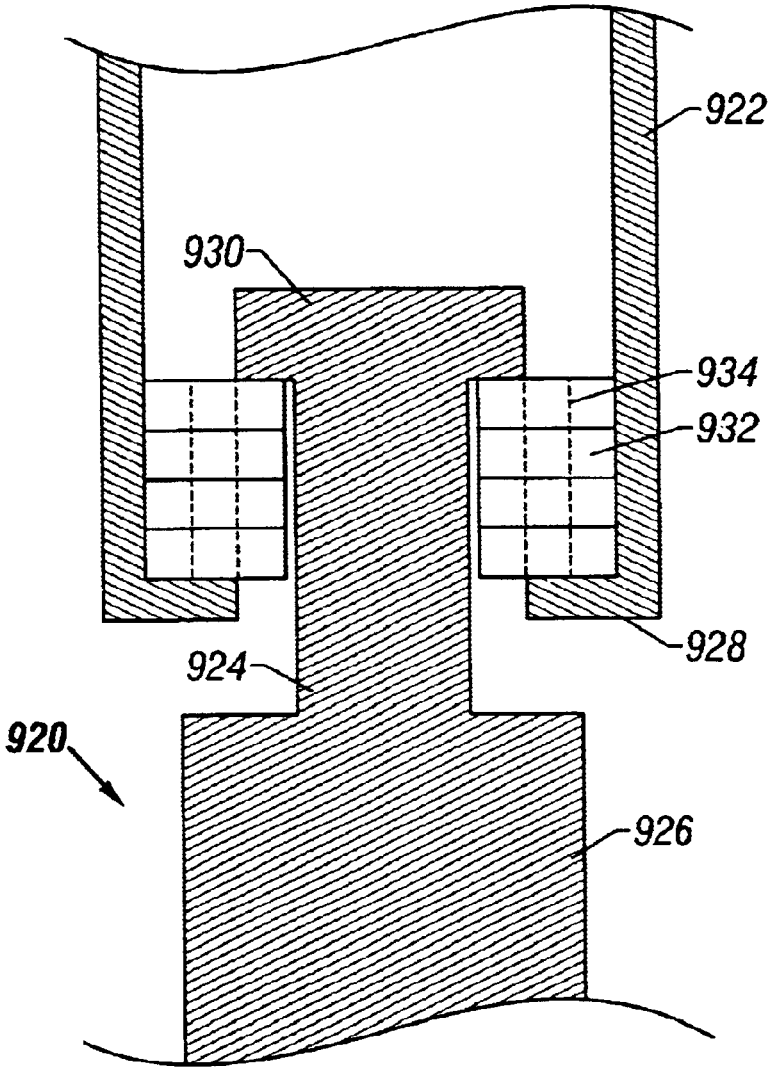

As noted above, jarring may be desirable to release anchor devices in accordance with various embodiments discussed herein. Referring to FIGS. 14A and 14B, jarring devices 900 and 920 are illustrated. Both jarring device 900 and 920 provide a gap to enable movement once the tool string has been set downhole to produce the jarring effect. As shown in FIG. 14A, the jarring device 900 includes a lower body 902 and an upper body 904 that are translatable with respect to each other. An outwardly flanged portion 906 at the upper end of the lower body 902 engages an inwardly flanged portion 908 at the lower end of the upper body 904. If a downwardly acting force is applied on the upper body 904, such as with a jarring tool run into the wellbore, the upper and lower bodies 904 and 902 are longitudinally translatable with respect to each other. However, to prevent such translation during running in of the tool and operation of the tool, a frangible element 910 may be provided between the upper and lower bodies 904 and 902. The lower end of the frangible element 910 sits on an upwardly facing surface 914 inside a lower body 902. The upper end of frangible element 910 abuts a downwardly facing surface 912 inside the upper body 904. A detonating cord 916 is run inside the frangible element 910. The frangible element 910 is a rigid body that prevents relative translation of the upper and lower bodies 904 and 902. In one embodiment, the frangible element 910 may be made up of a series of frangible disks. Initiation of the detonating cord 916 causes the frangible element 910 to break apart to remove the rigid support structure provided by the frangible element 910. As a result, if a downward force is applied on the upper body 904, then the inner surface 912 enables the upper body 904 to impact the flanged portion 906 of the lower body 902 to cause a jarring effect on the tool string, which is connected below the lower body 902.

As shown in FIG. 14B, another embodiment of the frangible element 920 includes a sleeve 922 and a support member 924 attached to a lower body 926. The lower body 926 is coupled to the rest of the tool string. The sleeve 922 at its lower end includes an inwardly flanged portion 928. The support member 924 at its upper end includes an enlarged portion 930. A frangible element 932 sits between the inwardly flanged portion 928 and the enlarged portion 930. In this embodiment, the frangible element 932 may be a cylindrical body with one or more detonating cords run through the frangible element 932. Upon activation of the detonating cord(s) 934, the frangible element 932 breaks apart to remove the support for the support member 924. This causes the lower body 926 and the attached tool string to drop, which creates a jarring effect that increases the likelihood of retraction of the anchoring device.

Figure 14C:
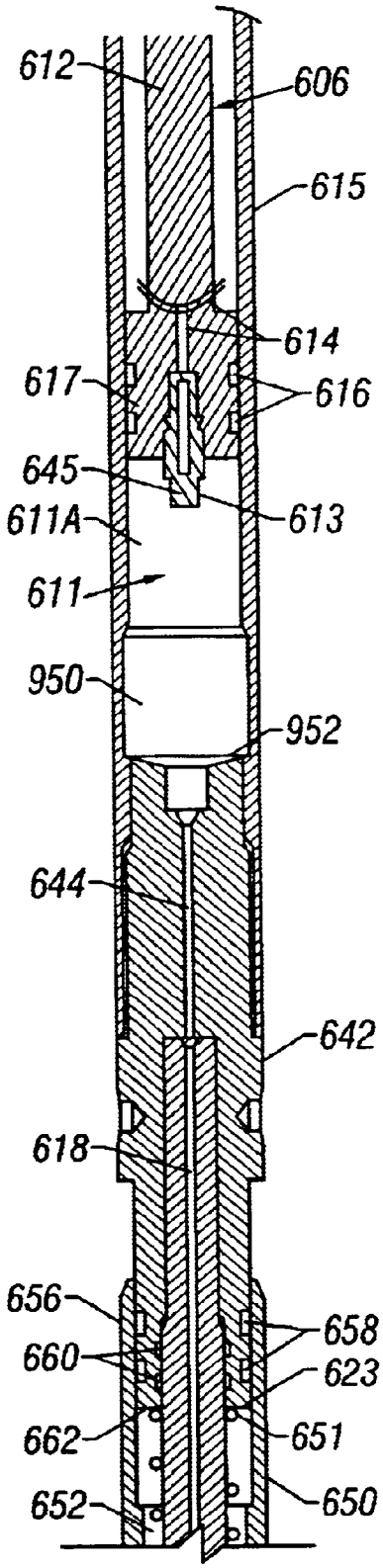

Referring to FIG. 14C, another type of jarring mechanism is provided. This jarring mechanism is included in the components of the anchoring device 600 shown in FIGS. 11A–11E. All elements remain the same except the second portion 611B of the chamber 611. In FIG. 14C, the second portion 611B has been replaced with a second portion 950. The second portion 950 has a diameter that is larger than the second portion 611B shown in FIG. 11C. The enlarged diameter of the second portion 950 allows clearance in the chamber 611 around the seals 616 in the power piston lower portion 617 so that fluid in the chamber 611 can flow around the seals 616 into the atmospheric chamber 606 when the power piston lower portion 617 moves into the second chamber portion 950. The power piston lower portion 617 is thus sealingly engaged with the inner wall of the chambers 611 in the first portion 611A. When the power piston lower portion 617 enters the second portion 950, however, the seal is lost. By providing a larger diameter than the second portion 611B (FIG. 11C), a more rapid downward movement of the power piston lower portion 617 can be provided. The faster downward movement provides a jarring effect when the bottom surface of the power piston lower portion 617 contacts an upper surface 952 of the adapter 642.

Figure 15:
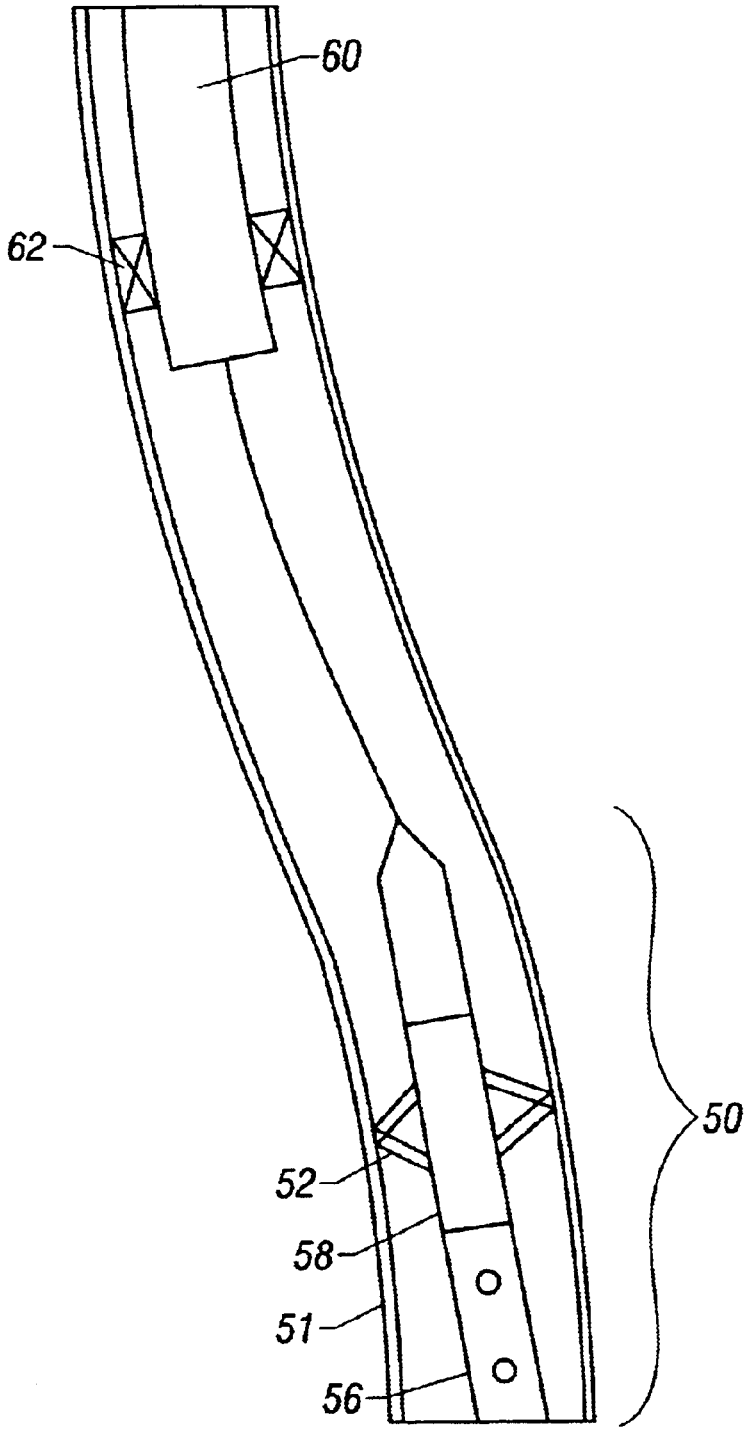
FIG. 15 illustrates another embodiment of a perforating gun string usable in a wellbore having a tubing or pipe.

According to further embodiments, through-tubing anchoring devices are attached to tool strings designed to run through a tubing, pipe and/or other restriction in the wellbore to a lined interval. This is illustrated in FIG. 15, in which a wellbore is lined with a liner 51 (linear or casing). A tubing 60 (e.g., production tubing) is installed in the liner 51, with a packer 62 set around the tubing 60 to isolate a liner-tubing annulus.

A perforating gun string 50 is run through the tubing 60 to a target interval in the wellbore. The perforating gun string 50 has a perforating gun 56 and an anchor device 58 with slips 52.

The anchor device 58, when in its retracted position, has an outer diameter that is less than the inner diameter of the tubing 60 and any other restriction in the wellbore. However, in its expanded state, the anchor device 58 has an outer diameter that can expand to the inner diameter of the liner 51 to firmly engage the liner 51.

According to some embodiments, the anchor device 58 is activated by use of a motor or some other driver (e.g., hydraulic driver, mechanical driver, and so forth). If a motor is used, a mechanism is provided in accordance with some embodiments to reduce the effects of "backlash." Backlash occurs due to the reflection force generated by the engagement of the slips 52 against the inner wall of the liner 51. Without the mechanism according to some embodiments of the invention, the backlash effect may cause a shaft in the motor to withdraw by some amount. This withdrawal may cause the force of the slips 52 against the liner 51 to be reduced, thereby weakening engagement of the slips 52 against the liner 51. Even a minute withdrawal of the motor shaft may be sufficient to reduce the engagement force of the anchor device against the liner 51, thereby reducing the effectiveness of the anchor device. In one embodiment, the mechanism for reducing the backlash effect includes a hydraulic module that is placed between the motor and the anchor device 58. The hydraulic module contains at least one chamber filled with a compressible fluid, with the compressible fluid absorbing the backlash effect. As used here, a "hydraulic module," although referred to in the singular, can actually include multiple components.

Also, instead of a hydraulic module, some other module having one or plural compressible elements can be used. Another example of a compressible element is a spring. More generally, a module to reduce backlash effect is referred to as backlash compensator module.

Figure 16:
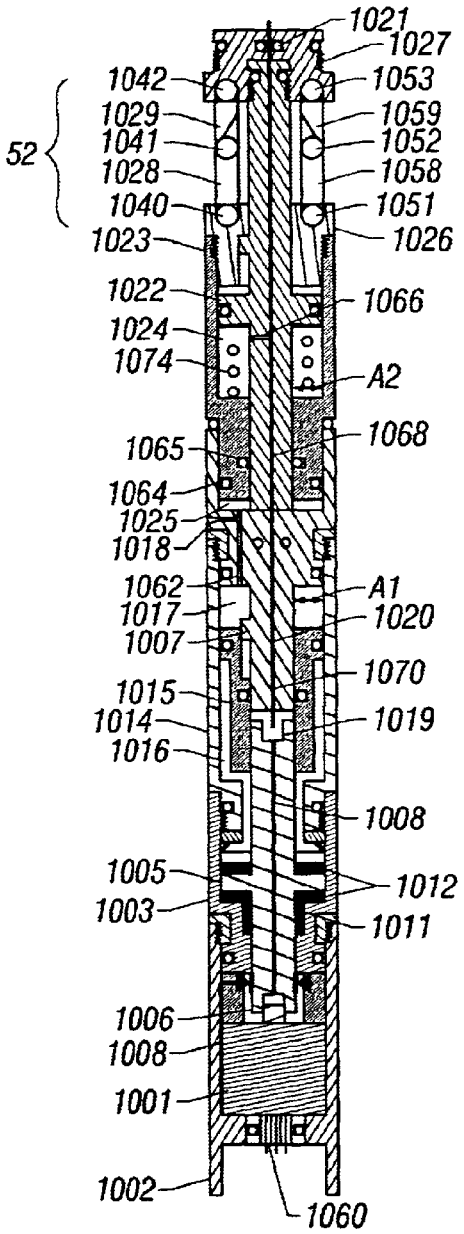
FIGS. 16 and 17 illustrate an anchor device according to another embodiment that can be used in the perforating gun string of FIG. 1, the anchor device having a motor, anchoring slips, and a hydraulic module between the motor and the anchoring slips.

FIG. 16 shows one embodiment of the anchor device 50 that includes a motor 1001 and a gripping assembly 52 having upper links 1028 and 1058 and lower links 1029 and 1059. As used here, a "gripping assembly" refers to any assembly adapted to engage an inner wall of a liner. Other embodiments of a gripping assembly are described further below. The links 1028 and 1029 are pivotably connected to each other by a pivot element 1041, with the other end of the upper link 28 connected by pivot element 1040 to an upper link adapter 1026 of the tool. The other end of the lower link 1029 is connected by a pivot element 1042 to a lower link adapter 1027. Similarly, the links 1058 and 1059 are pivotably connected to each other by a pivot element 1052. The other end of the upper link 1058 is connected to the upper link adapter 1026 by a pivot element 1051, and the other end of the lower link 1059 is connected by a pivot element 1053 to the lower link adapter 1027.

A benefit offered by the use of the motor 1001 is the ability to operate the anchor device 50 multiple times; that is, the anchor device 50 can be activated and retracted a plurality of times. A wireline or other communications channel (not shown) supplies power and commands to the motor to operate the motor in either the forward or reverse direction.

The motor 1001 is contained in a motor housing 1002. An electrical connector 1060 enables an electrical connection to be made to the motor 1001. The motor housing 1002 is connected to a bearing housing 1003 via a chassis 1004. The rotor of the motor 1001 is connected to a power shaft 1005 by a coupling assembly 1006. The power shaft 1005 is rotated when the motor 1001 is energized.

A through-cable 1008 is connected to the electrical connector 1060. The term "through-cable" refers to one or more electrical wires. The through-cable 1008 maintains electrical continuity with the through-cable 1020 through the slip ring assembly 1009 when the power shaft 1005 rotates.

The through-cable 1008 is electrical connected to another through-cable 1012, which is routed through a central longitudinal bore 1070 of a piston adapter 1018 and a central longitudinal bore 1068 of an actuation shaft 1022. A spring contact assembly 1019 maintains electrical continuity between the through-cable 1010 and the through-cable 1020. The through-cable 1012 continues through a feed-through connector 1021 in the lower link adapter 1027. The through-cable 1012 is run to a point below the anchor device 58 for operating other devices below the anchor device 58.

The power shaft 1005 floats inside the bearing housing 1003 on a radial bearing 1011 and thrust bearing 1012. Other types of bearings can be used in other embodiments.

The lower end of the power shaft 1005 is a power screw, which translates rotational torque to a longitudinal force. The power screw includes the threaded connection (according to some embodiments) between the lower portion of the power shaft 1005 and a power piston 1015.

The power shaft 1005 is threadably connected to the power piston 1015 in a piston housing 1014. The seals on the inner surface and outer surface of the power piston 1015 separate a reversing fluid chamber 1016 and actuation fluid chamber 1017. The fluid contained in the chambers 1016 and 1017 includes compressible oil, in one embodiment. In other embodiments, other types of compressible fluids can be used. A key 1007 on the shaft of a piston adapter 1018 prevents the power piston 1015 from rotating when the power shaft 1005 rotates. Thus, when the power shaft 1005 rotates, the power piston 1015 moves longitudinally.

A conduit 1062 provides a path between the actuation fluid chamber 1017 and another fluid chamber 1025. Seals 1064 on an actuation adapter 1023 isolates the chamber 1025 from downhole fluid. Seal 1065 isolates the chamber 1025 from the chamber 1024. The chamber 1024 communicates through a radial port 1066 to the central bore 1068 of the actuation shaft 1022. The central bore 1068 leads to the central bore 1070, which is in fluid communication with the chamber 1016. The actuation adapter 1023 is generally a "piston" that is moved by differential pressure in the chambers 1024 and 1025.

A spring 1074 is provided in the chamber 1024. The spring 1074 provides an opposing force against downward movement of the actuation adapter 1023. A lower end of the actuation adapter 1023 is engaged with the upper link adapter 1026. Thus, downward movement of the actuation adapter 1023 causes a corresponding downward movement of the upper link adapter 1026. This movement causes an expansion of the links 1028, 1029, 1058, and 1059 due to rotation about pivot elements 1040, 1041, 1042, 1051, 1052, and 1053. The lower link adapter 1027 is fixed in position.

The chamber 1017 defines an annular cross-sectional area A1, and the chamber 1024 defines an annular cross-sectional area A2. The chamber 25 also has a cross sectional area A2. As long as A1 is equal to A2, the force applied by downhole pressure acting on the actuation adapter 1023 is balanced.

The lower end of the actuation shaft 1022 is threadably connected to the lower link adapter 1027.

Figure 18:
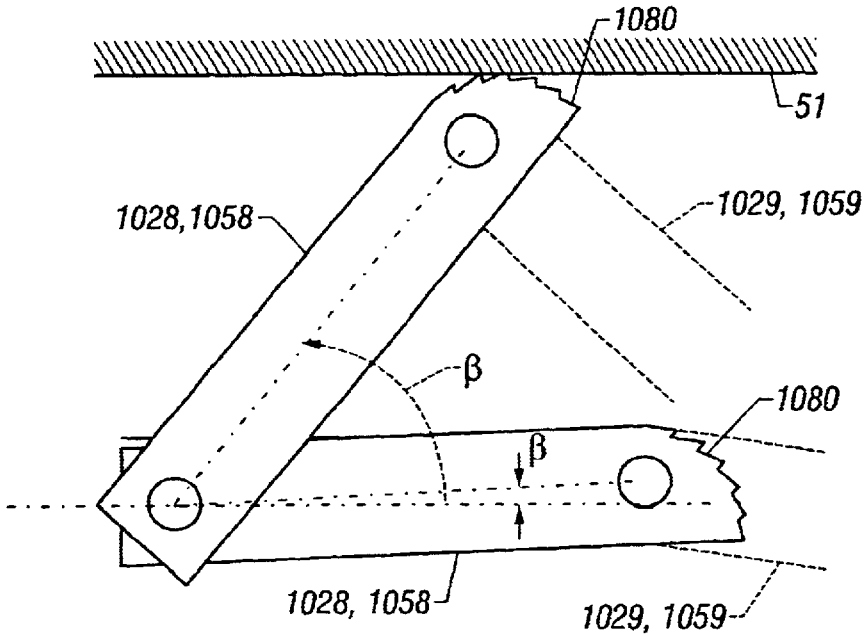
FIG. 18 illustrates an anchoring gripping assembly used in the anchor device of FIG. 17.

In one embodiment, there are three (two shown in FIG. 16) pairs of linkages connected to the upper link adapter 26 and the lower linkage adapter 27. Each pair is 120° apart and contains an upper link and a lower link. As shown in FIG. 18, a lower end of the upper link has a sloped surface with a teeth profile 1080 to grip the liner 51 once the anchor mechanism is activated. FIG. 18 shows retracted and expanded positions of the upper and lower links. Alternatively, instead of the teeth profile 1080, some other types of engagement surfaces can be used. For example, the engagement surface can be a high friction surface (e.g., a roughened surface) to engage a liner. Alternatively, a link can have a profile for mating with a corresponding profile in a liner.

When the anchor device 58 is in its retracted position, the initial state of the arm angle, $\beta_o$ (the angle of the upper link relative to a horizontal axis in FIG. 18) is slightly larger than zero in order to ensure that the pivoting of the upper link will be counterclockwise. When an axial force Fa is applied against the upper end of the upper link, the upper and lower links move radially outwardly to eventually engage the liner 51 with the teeth profile 1080. The radial force applied to the casing is denoted Fr.

In the illustrated embodiment, the gripping assembly 52 has one expanded position. In alternative embodiments, plural expanded positions are provided by the gripping assembly 52 that provide different outer diameters. The anchor device actuator can be actuated to set the gripping assembly 52 at one of the plural positions depending on the inner diameter of the liner.

Figure 17:
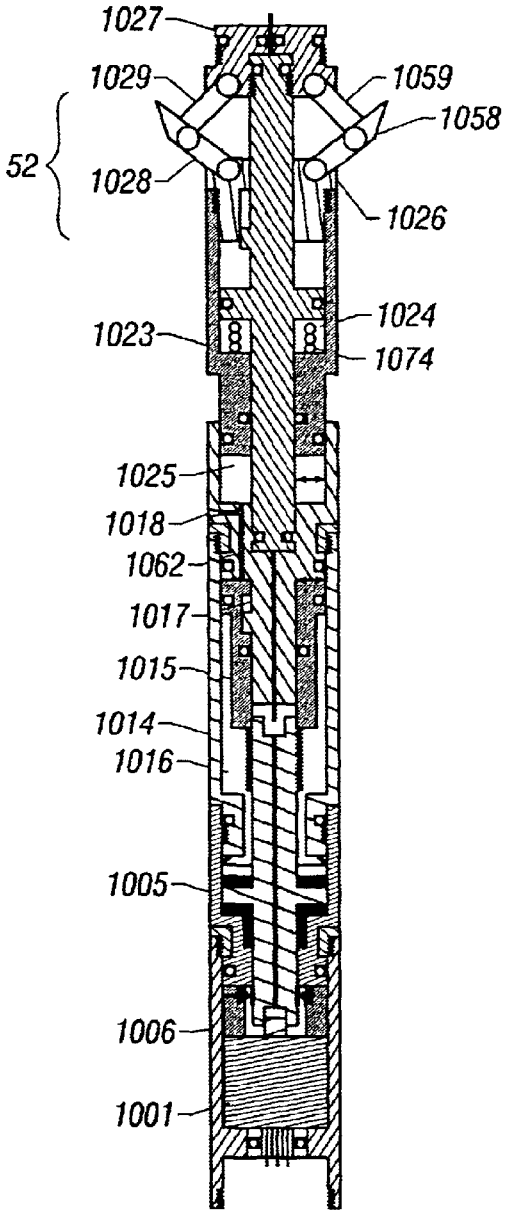

In operation, when the motor 1001 starts to rotate, such as in the counterclockwise direction, the power shaft 1005 rotates in the same direction. This drives the power piston 1015 downwardly by the power screw, as shown in FIG. 17. In turn, the power piston 1015 pushes the actuation oil in the chamber 1017 through the conduit 1062 into the chamber 1025. The increased pressure in the chamber 1025 causes the actuation adapter 1023 to move downwardly. However, note that the actuation shaft 1022 remains stationary. The downward movement of the actuation adapter 1023 causes the chamber 1024 to become smaller, and as a result, fluid flows from the chamber 1024 through the radial conduit 1066 into the central conduit 1068. The fluid flows up conduits 1068 and 1070 into chamber 1016. Since area A1 is equal to area A2, the mechanical force generated by the power screw is the same as the hydraulic force exerted on the actuation adapter 1023.

When the actuation adapter 1023 moves downwardly, the upper link adapter 1026 moves in the same direction while the lower link adapter 1027 remains stationary. This causes the upper links 1028 and 1058 and the lower links 1029 and 1059 to pivot radially outwardly. The engagement teeth 1080 on the upper links 1028 and 1058 eventually engage the inner surface of the liner 51 to set the anchor.

At a moment when the anchor device 1052 engages the liner 51, the force acting on the liner 51, as well as the torque on the motor 1001, rises. When the torque reaches a preset value as detected by the motor controller, the motor controller automatically shuts off the motor 1001.

When the motor 1001 rotates in the other direction (e.g., clockwise direction), the power piston 1015 moves upwardly. This forces some of the fluid in the chamber 1016 back into the chamber 1024 through the conduits 1070, 1068, and 1066. As a result, the actuation adapter 1023 moves upwardly to push the actuation oil in the chamber 1025 back to where it was before activation.

When the actuation adapter 1023 moves upwardly, the upper link adapter 1026 moves in the same direction while the lower link adapter 1027 stays stationary. This causes the upper links 1028 and 1058 and the lower links 1029 and 1059 to retract radially inwardly to their original positions. At this point, the anchor device 58 has returned to its retracted position, as shown in FIG. 16.

Figure 19C:
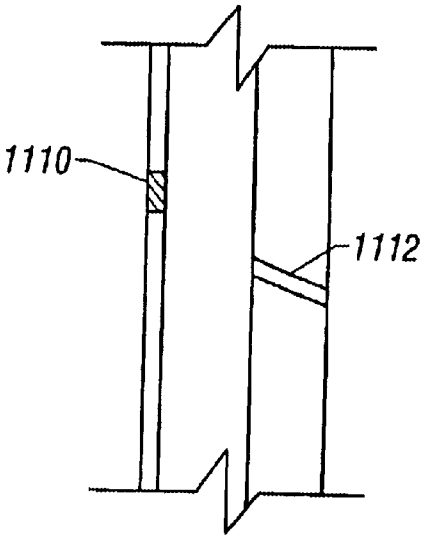
FIGS. 19A–19C illustrate anchoring gripping assemblies according to other embodiments.
Figure 19B:
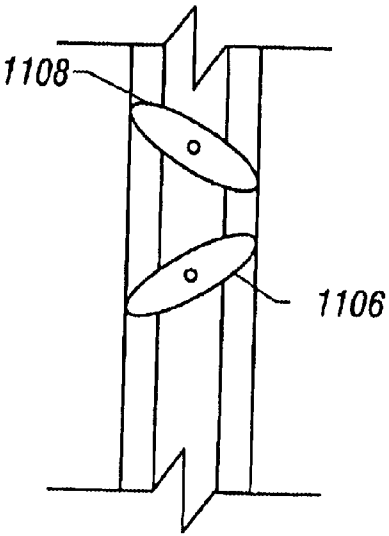
Figure 19A:
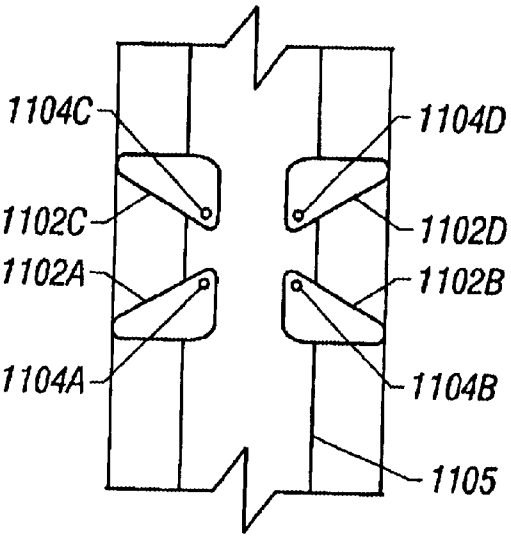

Alternative designs of the anchor devices with other types of gripping assemblies can be used in other embodiments. For example, FIGS. 19A, 19B, and 19C show three of the many possible alternative designs. FIG. 19A shows an anchor device having two pairs of generally leaf-shaped slips 1102A, 1102B, 1102C, and 1102D. The slips 1102A–D are pivotably connected to a housing 1105 of the anchor device by respective pivot elements 1104A–D.

FIG. 19A shows the anchor device in its expanded position. The pair of slips 1102A, 1102B engage the liner inner surface to prevent downward movement of the anchor device, while the pair of slips 1102C, 1102D engage the inner surface of the liner to prevent upward movement of the anchor device.

Another arrangement is shown in FIG. 19B, which illustrates an anchor device having two generally elliptical slips 1106 and 1108. When expanded, the slips 1106 and 1108 are angled towards each other to provide anchoring in two different directions. The slip 1106 prevents upward movement of the tool, while the slip 1108 prevents downward movement of the anchor. To retract, the slips 1106 and 1108 are rotated to be generally aligned longitudinally along the tool.

In FIG. 19C, another anchor device includes eccentric slips 1110 and 1112. In its expanded state, the slip 1110 protrudes outwardly from the body of the anchor device to engage one side of the liner, while the slip 1112 pivots radially outwardly to engage the liner inner wall. The slip 1110 protrudes outwardly by a relatively small amount, while the slip 1112 protrudes outwardly by a larger amount to position the anchor device in an eccentric position. The eccentric nature of the anchoring slips 1110 and 1112 causes the tool to be closer to one side of the liner than another.

Figure 20:
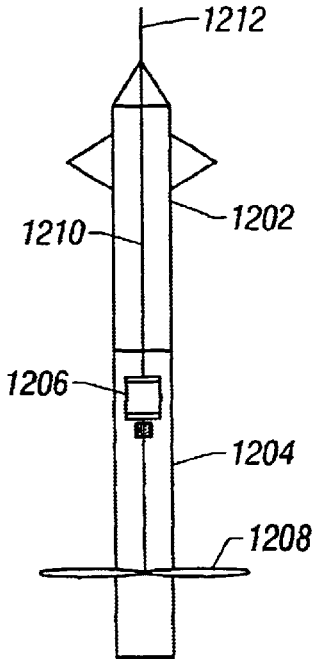
FIG. 20 illustrates a tool string having an anchor device and a cutter.

In another embodiment, any one of the anchor devices described herein can be used with a pipe cutter. A tool string as shown in FIG. 20 has an anchor device 1202 and a pipe cutter 1204. The pipe cutter 1204 includes a motor 1206, which is operatively connected to blades 1208 that when activated expand outwardly from the body of the cutter 1204. The blades 1208 are rotated by the motor 1206 to cut through a downhole structure, such as a tubing, pipe, or other structure.

The motor 1206 is electrically connected by a through-cable 1210 through the anchor device 1202 to a carrier line 1212. Power and commands are communicated down the carrier line 1212 and the through-cable 1210.

Figure 21:
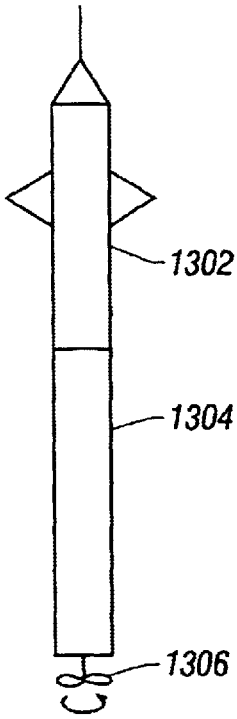
FIG. 21 illustrates a tool string having an anchor device and a flow rate logging device.

In another application, as shown in FIG. 21, a tool string includes an anchor device 1302 that is connected to a monitoring module 1304. The monitoring module 1304 may include a spinner or a propeller 1306. In a gas well, the spinner or propeller 1306 can be used to measure flow rate of fluid (e.g., gas or liquid) from a reservoir adjacent the wellbore. The tool string shown in FIG. 21 enables the performance of a flow rate logging operation.

In operation, the logging string is lowered into the wellbore, and the anchor device 1302 is set. Flow rate logging can then be performed, in which fluid flow rate determine the rotational rate of the spinner and propeller 1306.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for use in a wellbore having a liner, comprising:

lowering a tool string having an anchor device through a restriction positioned in the wellbore, the anchor device having a retracted state, the anchor device in the retracted state having an outer diameter less than an inner diameter of the restriction;

positioning the tool string at a target interval within the liner; and expanding the anchor device to an expanded state to actuate a gripping assembly of the anchor device to engage the liner, wherein expanding the anchor device is performed by an actuator assembly that includes a release mechanism having a detonator initiable by an actuating signal to the actuator assembly.

2. The method of claim 1, wherein actuating the gripping assembly comprises actuating the gripping assembly to one of plural available positions corresponding to different outer diameters of the anchor device.

3. A method for use in a wellbore having a liner, comprising:

lowering a tool string having an anchor device through a restriction positioned in the wellbore, the anchor device having a retracted state, the anchor device in the retracted state having an outer diameter less than an inner diameter of the restriction;

positioning the tool string at a target interval within the liner; and expanding the anchor device to an expanded state to actuate a gripping assembly of the anchor device to engage the liner, wherein expanding the anchor device comprises communicating one or more commands to the anchor device; and activating a motor in the anchor device with the one or more commands.

4. The method of claim 3, wherein lowering the tool string through the restriction comprises lowering the tool string through a tubing.

5. The method of claim 3, wherein the gripping assembly has an outer diameter sufficient to engage the inner surface of the liner when the anchor device is in the expanded state.

6. The method of claim 3, further comprising providing a backlash compensator module between the motor and the gripping assembly.

7. The method of claim 3, wherein expanding the anchor device comprises actuating the gripping assembly by communicating power from the motor through a hydraulic module to the gripping assembly.

8. The method of claim 7, wherein communicating power from the motor through the hydraulic module comprises:

converting rotational power of the motor to translational power using a power screw; and actuating a piston in the hydraulic module.

9. The method of claim 3, wherein expanding the anchor device comprises actuating the gripping assembly by communicating power from the motor through a module having a compressible element.

10. The method of claim 3, wherein actuating the gripping assembly comprises moving an assembly of pivotably connected links radially outwardly.

11. The method of claim 10, wherein moving the assembly of pivotably connected links comprise moving at least one of the links having a teeth profile adapted to engage the liner.

12. The method of claim 10, wherein moving the assembly of pivotably connected links comprises moving at least one of the links having a high friction surface to engage the liner.

13. The method of claim 10, wherein moving the assembly of pivotably connected links comprises moving at least one of the links having a profile to mate to a corresponding profile in the liner.

14. The method of claim 3, wherein lowering the tool string comprises lowering a perforating gun.

15. The method of claim 3, wherein lowering the tool string comprises lowering the tool string on a non-rigid carrier.

16. An apparatus for use in a wellbore having a liner and a restriction positioned in the liner, comprising:

an anchor device having a gripping assembly, the gripping assembly when in a retracted state having an outer diameter less than an inner diameter of the restriction, the gripping assembly when in an expanded state having an outer diameter substantially the same as an inner diameter of the liner to enable the gripping assembly to engage the liner; and a motor to actuate the gripping assembly to the expanded state.

17. The apparatus of claim 16, wherein the restriction comprises a tubing having an inner diameter less than the inner diameter of the liner.

18. The apparatus of claim 16, wherein the gripping assembly comprises pivotably connected links adapted to be moved radially outwardly when actuated.

19. The apparatus of claim 18, wherein the gripping assembly further comprises:

a first pivot element connecting a first link and a second link;

a second pivot element connecting the first link to a first portion of the anchor device; and a third pivot element connecting the second link to a second portion of the anchor device.

20. The apparatus of claim 19, wherein the first portion comprises an actuator.

21. The apparatus of claim 20, wherein the actuator comprises a piston and at least two chambers containing compressible fluid.

22. The apparatus of claim 20, wherein the actuator comprises a piston and at least two chambers containing incompressible fluid.

23. The apparatus of claim 21, wherein the motor is operatively coupled to the actuator.

24. An apparatus for use in a wellbore having a liner and a restriction positioned in the liner, comprising:

an anchor device having a gripping assembly, the gripping assembly when in a retracted state having an outer diameter less than an inner diameter of the restriction, the gripping assembly when in an expanded state having an outer diameter substantially the same as an inner diameter of the liner to enable the gripping assembly to engage the liner, wherein the anchor device further comprises a motor and a hydraulic module between the motor and the gripping assembly.

25. The apparatus of claim 24, further comprising a power member and a mechanism adapted to convert rotational movement of the motor to translational movement of the power member.

26. The apparatus of claim 25, wherein the hydraulic module comprises a piston and at least two chambers filled with compressible fluid.

27. An anchoring apparatus for use in a wellbore, comprising:

a motor;

a module having at least one compressible element; and a gripping assembly adapted to be actuated by the motor through the at least one compressible element in the module.

28. The anchoring apparatus of claim 27, wherein the motor is electrically-activated.

29. The anchoring apparatus of claim 27, further comprising:

an actuation member; and a translator module to translate rotational movement of the motor to longitudinal movement of the actuation member, the actuation member adapted to operate the gripping assembly.

30. The anchoring apparatus of claim 29, wherein the module comprises a hydraulic module.

31. The anchoring apparatus of claim 30, wherein the hydraulic module comprises a piston and at least two chambers on first and second sides of the piston.

32. The anchoring apparatus of claim 31, wherein the at least first and second chambers contain compressible fluid.

33. The anchoring apparatus of claim 31, further comprising a third chamber and a conduit to communicate fluid between the third chamber and the first chamber, the actuation member to push fluid from the third chamber into the first chamber.

34. The anchoring apparatus of claim 33, further comprising a fourth chamber and a communications channel between the second chamber and the fourth chamber.

35. The anchoring apparatus of claim 34, further comprising a spring in the second chamber to oppose motion of the piston in a first direction.

36. The anchoring apparatus of claim 31, wherein the first and second chambers have substantially the same cross-sectional area.

37. An apparatus for use in a wellbore, comprising:

a cutter device having at least one blade to cut through a downhole structure; and an anchor device connected to the cutter device, the anchor device adapted to engage the wellbore.

38. The apparatus of claim 37, wherein the anchor device has a gripping assembly with a retracted state and an expanded state, the gripping assembly when in the retracted state having an outer diameter less than an inner diameter of a tubing in the wellbore; and the gripping assembly when in the expanded state having an outer diameter greater than an outer diameter of the tubing.

39. The apparatus of claim 37, further comprising a motor to actuate the anchor device.

40. An apparatus for use in a wellbore comprising:

a measurement device adapted to measure fluid flow rate in the wellbore; and an anchor device coupled to the measurement device, the anchor device adapted to engage the wellbore when in an expanded state, the anchor device adapted to pass through a restriction in the wellbore when in a retracted state, the anchor device adapted to engage the wellbore at an interval with a dimension larger than that of the restriction.

41. The apparatus of claim 40, wherein the anchor device is adapted to pass through a tubing, the restriction comprising the tubing.

42. The apparatus of claim 40, wherein the measurement device comprises a spinner.

* * * * *